US010471740B2

(12) United States Patent
Momomura et al.

(10) Patent No.: US 10,471,740 B2
(45) Date of Patent: Nov. 12, 2019

(54) DRYING UNIT AND DROPLET EJECTION DEVICE

(71) Applicant: FUJI XEROX CO., LTD., Tokyo (JP)

(72) Inventors: Yasunori Momomura, Yokohama (JP); Yoshitaka Kuroda, Yokohama (JP); Masayuki Yamagishi, Yokohama (JP); Shunsuke Yamasaki, Yokohama (JP); Yasuhisa Gonda, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 16/115,816

(22) Filed: Aug. 29, 2018

(65) Prior Publication Data

US 2019/0283456 A1 Sep. 19, 2019

(30) Foreign Application Priority Data

Mar. 14, 2018 (JP) ..... 2018-046334

(51) Int. Cl.
*B41J 11/00* (2006.01)

(52) U.S. Cl.
CPC ..... *B41J 11/002* (2013.01); *B41J 11/0085* (2013.01)

(58) Field of Classification Search
CPC combination set(s) only.
See application file for complete search history.

(56) References Cited

U.S. PATENT DOCUMENTS

2017/0219282 A1 8/2017 Uesaka et al.
2018/0001665 A1* 1/2018 Isozaki ..... B41J 2/01

FOREIGN PATENT DOCUMENTS

JP 2017-133774 8/2017
JP 2018-001509 1/2018

* cited by examiner

*Primary Examiner* — Bradley W Thies
(74) *Attorney, Agent, or Firm* — Fildes & Outland, P.C.

(57) ABSTRACT

A drying unit includes: an irradiation portion that radiates laser light to a recording medium being fed in a predetermined feeding direction, so as to evaporate moisture of liquid droplets adhering to the recording medium; a supply portion that blows and supplies air to a space between the irradiation portion and the recording medium through and outlet from a position at a downstream side of the irradiation portion in the feeding direction; an absorption portion that absorbs at least a part of the air flowing to an upstream side in the feeding direction along the recording medium in a position at an upstream side of the irradiation portion in the feeding direction; and a suction guide unit as defined herein.

10 Claims, 19 Drawing Sheets

DRYING UNIT AND DROPLET EJECTION DEVICE

CROSS-REFERENCE TO RELATED APPLICATIONS

This application is based on and claims priority under 35 USC 119 from Japanese Patent Application No. 2018-046334 filed on Mar. 14, 2018.

BACKGROUND

1. Technical Field

The present invention relates to a drying unit, and a droplet ejection device.

2. Related Art

In the background art, for example, a drying unit or a droplet ejection device disclosed in JP-A-2017-133774 and JP-A-2018-1509 has been known as a drying unit for irradiating a recording medium with laser light to thereby evaporate moisture of liquid droplets adhering to the recording medium, or a droplet ejection device using the drying unit.

JP-A-2017-133774 discloses a drying unit including: a plurality of light emitting portions that are disposed at intervals along a feeding direction in which a fed object including liquid droplet is fed, and that irradiate the fed object with light to thereby evaporate the liquid droplets; and a ventilation mechanism in which supply portions and discharge portions are disposed alternately along the feeding direction for spaces on an upstream side and a downstream side in the feeding direction with respect to the light emitting portions as a whole and spaces among the light emitting portions, so that the supply portions supply air toward the fed object along a direction of irradiation with the light, and the air is discharged in an opposite direction to the irradiation direction from the fed object side through the discharge portions.

JP-A-2018-1509 discloses a droplet ejection device including: an ejection head that ejects liquid droplets onto a recording medium; an irradiation portion that is disposed on a downstream side of the ejection head in a feeding direction of the recording medium so as to irradiate the recording medium with infrared laser light to thereby evaporate moisture of the liquid droplets landed on the recording medium; a rectification portion that is disposed on an upstream side of the irradiation portion in the feeding direction of the recording medium so as to extend along the feeding direction; a supply portion that supplies air from the rectification portion toward above the recording medium so that the air flows downstream in the feeding direction of the recording medium; and a discharge portion that is disposed on a downstream side of the irradiation portion in the feeding direction of the recording medium so as to discharge at least a part of the air flowing above the recording medium and downstream in the feeding direction.

SUMMARY

Aspects of non-limiting embodiments of the present disclosure relate to a drying unit capable of suppressing shaking occurring in a recording medium when air is suppled from a supply portion disposed in a position on a downstream side in a feeding direction of the recording medium with respect to an irradiation portion for irradiating the recording medium with laser light to thereby evaporate moisture of liquid droplets adhering to the recording medium, and a droplet ejection device using the drying unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a drying unit including: an irradiation portion that radiates laser light to a recording medium that is being fed in a predetermined feeding direction, so as to evaporate moisture of liquid droplets adhering to the recording medium; a supply portion that blows and supplies air to a space between the irradiation portion and the recording medium through an outlet from a position on a downstream side of the irradiation portion in the feeding direction; an absorption portion that absorbs at least a part of the air flowing to an upstream side in the feeding direction along the recording medium in a position on an upstream side of the irradiation portion in the feeding direction; and a suction guide unit including a contact guide portion that sucks the recording medium in a position opposite to the irradiation portion with respect to the recording medium, the position corresponding to at least a part of a region extending from an irradiation range of the laser light radiated from the irradiation portion to the outlet of the supply portion, so that the recording medium is brought into contact with the contact guide portion and guided to pass through the drying unit.

BRIEF DESCRIPTION OF THE DRAWINGS

Exemplary embodiments of the present invention will be described in detail based on the following figures, wherein.

DESCRIPTION OF REFERENCE NUMERALS AND SIGNS

Figure 1:
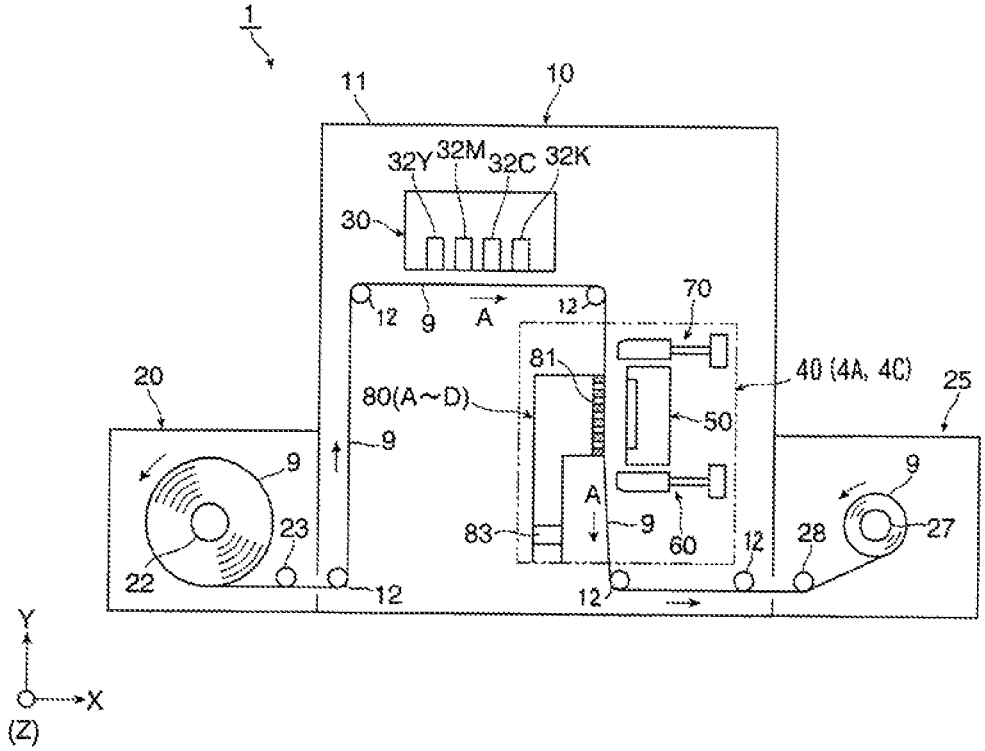
FIG. 1 is a conceptual view illustrating a configuration of a droplet ejection device according to Exemplary Embodiment 1.

1 . . . inkjet recording apparatus (example of droplet ejection device)
4 (4A, 4C) . . . drying unit
9 . . . continuous paper (example of recording medium)
30 . . . droplet ejection portion
35 . . . ink droplet (example of droplet)
40 . . . drying portion
60 . . . supply portion
62 . . . outlet
70 . . . absorption portion
80 (80A-80D) . . . suction guide portion
81 (81A, 81B) . . . contact guide portion
85 (85C, 85D) . . . contact guide portion
82, 86 . . . suction hole
A . . . feeding direction
B . . . widthwise direction
S . . . irradiation range of laser light
R . . . region extending from irradiation range of laser light to outlet of supply portion

DETAILED DESCRIPTION

Exemplary embodiments for carrying out the present invention will be described below with reference to the drawings.

Exemplary Embodiment 1

Figure 2:
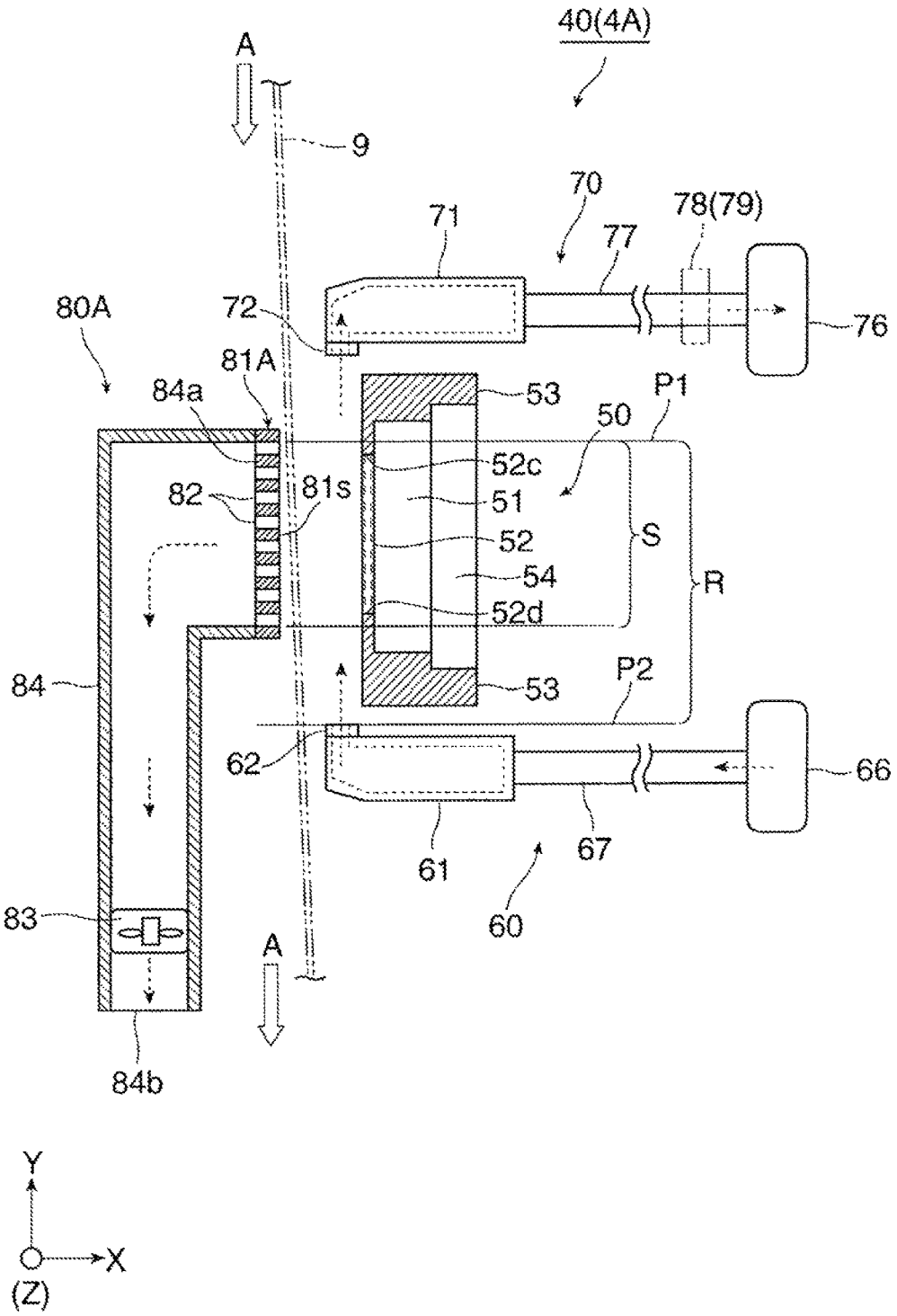
FIG. 2 is a partially sectional conceptual view illustrating a configuration of a drying unit according to Exemplary Embodiment 1.
Figure 3:
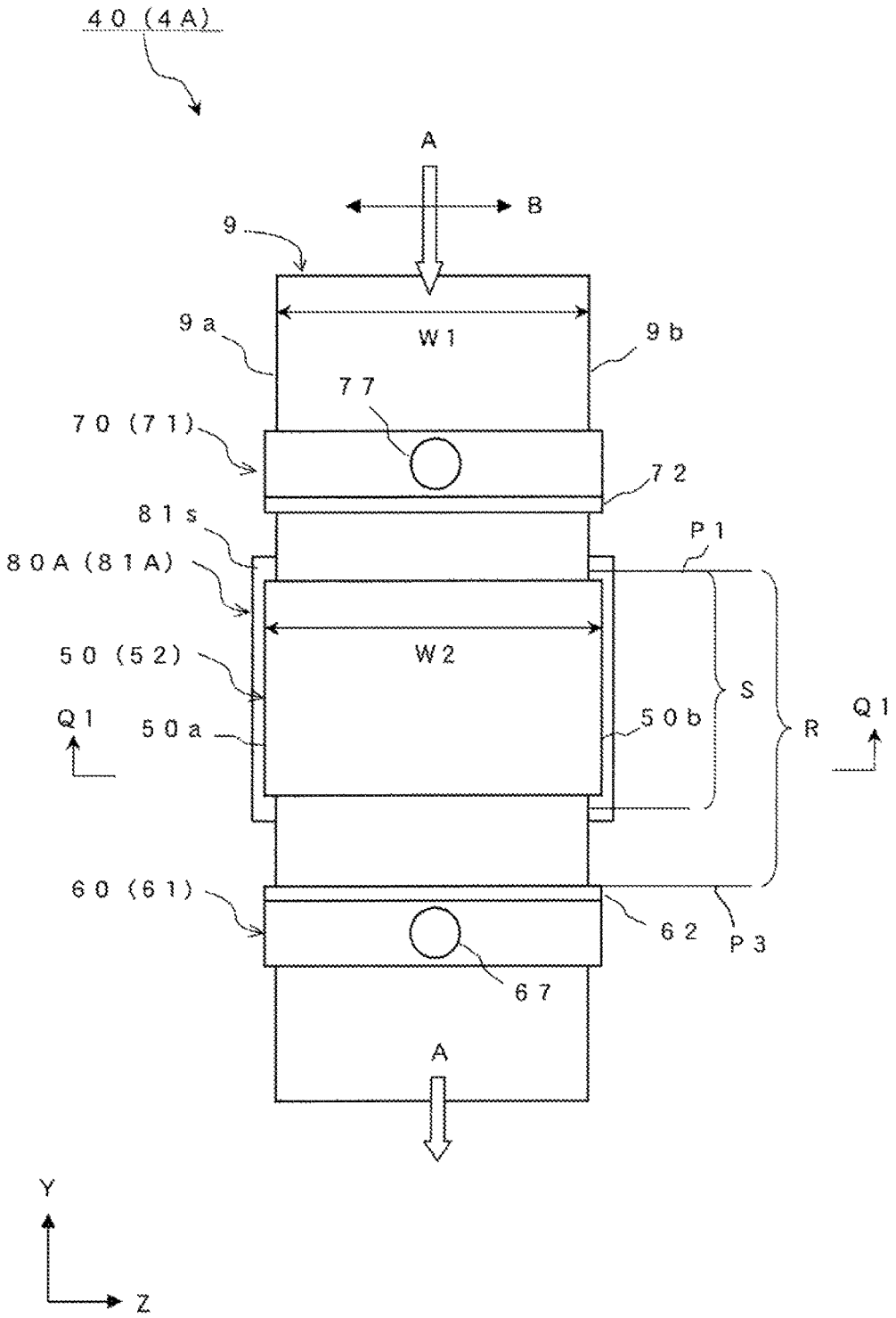
FIG. 3 is a conceptual view illustrating the configuration of the drying unit in FIG. 2, which is observed laterally.

FIG. 1 to FIG. 3 illustrate a droplet ejection device provided with a drying unit according to Exemplary Embodiment 1. FIG. 1 illustrates the overall configuration of the droplet ejection device. Each of FIG. 2 and FIG. 3 illustrates the configuration of the drying unit.

Arrows shown by the reference signs X, Y and Z in each drawing designate directions of width, height and. depth in a three-dimensional space assumed in the drawing respectively. In addition, a blank circle at the intersection of the X and Y directions in each drawing of FIG. 1, FIG. 2, and so on designates that the Z direction faces downward perpendicularly to the drawing.

<Configuration of Droplet Ejection Device>

A droplet ejection device 1 according to Exemplary Embodiment 1 is arranged as an inkjet recording apparatus which ejects ink droplets as an example of liquid droplets onto continuous paper 9 as an example of a recording medium to thereby form an image such as characters, figures, patterns, photographs, etc. on the continuous paper 9.

As illustrated in FIG. 1, the droplet ejection device 1 serving as an inkjet recording apparatus has an image forming portion 10, a feeding portion 20, and a take-up portion 25. The image forming portion 10 ejects ink droplets onto the continuous paper 9 to thereby form an image thereon. The feeding portion 20 feeds out the continuous paper 9 to the image forming portion 10. The take-up portion 25 takes up the continuous paper 9 where the image has been formed by the image forming portion. 10.

The feeding portion 20 is constituted by an unwind roll 22, a support roll 23, and so on. The continuous paper 9 is wound like a roll around the unwind roll 22 which is rotatable. The feeding portion 20 unwinds a required amount (length) of the continuous paper 9 from the unwind roll 22, and then feeds out the continuous paper 9 to the image forming portion 10 through the support roll 23. In fact, the continuous paper 9 is, for example, fed by use of winding power of the take-up portion 25.

The take-up portion 25 is constituted by a take-up roll 27, a support roll 28, and so on. The take-up roll 27 takes up the continuous paper 9 where the image has been formed. In the take-up portion 25, the take-up roll 27 is rotationally driven to take up the continuous paper 9 which has been fed from the image forming portion 10 through the support roll 28.

In addition, inside the image forming portion 10, the continuous paper 9 is fed at a required rate while passing through required positions along a feeding path formed by a plurality of support rolls 12 and so on. An arrow A in each drawing designates the feeding direction of the continuous paper 9.

The image forming portion 10 is constituted by a housing 11 that also serves as a reception chamber, a droplet ejection portion 30 that is disposed inside the housing 11, a drying portion 40, etc.

Of those members, the housing 11 is provided with a not-shown opening/closing door or the like, which can be opened and closed for working of maintenance, inspection or the like in order to enable access to the inside of the housing 11.

The droplet ejection portion 30 is a part relating to a configuration that ejects ink droplets onto the continuous paper 9, which is being fed thereto, in accordance with information of an image.

The droplet election portion 30 is constituted by four ink recording heads 32Y, 32M, 32C and 32K which eject ink droplets of four colors, that is, yellow (Y), magenta (M), cyan (C) and black (K) respectively and individually, not-shown driving units which drive the ink recording heads 32 (Y, M, C and K) respectively based on the information of the image or the like, not-shown ink supply units which supply inks of the colors to the ink recording heads 32 (Y, M, C and K) respectively, etc.

The ejection heads 32 (Y, M, C and K) are disposed on the paper side of the continuous paper 9 so as to be arranged in a row in this order along the feeding direction A of the continuous paper 9. Each of the ink recording heads 32 (Y, M, C and K) has a configuration in which a plurality of nozzles each ejecting an ink droplet with a required size are arrayed in a required pattern. The ink recording heads 32 (Y, M, C and K) are driven by the not-shown driving units based on image information inputted to the droplet ejection device 1.

In the droplet ejection portion 30, ink droplets of specified colors are ejected from the nozzles in the ink recording heads 32 (Y, M, C and K) respectively to one surface of the continuous paper 9, which is being fed and supported substantially horizontally inside the housing 11, in accordance with the information of the image. Thus, ink droplets of some colors of the four colors or all the four colors are attached to the one surface of the continuous paper 9 so as to form the image thereon. Thus, the image is formed out of the inks.

The drying portion 40 is disposed on the downstream side of the droplet ejection portion 30 in the feeding direction A of the continuous paper 9. The drying portion 40 is a part relating to a configuration in which the continuous paper 9 having passed through the droplet ejection portion 30 is irradiated with laser light to thereby evaporate and dry moisture of the ink droplets ejected onto the continuous paper 9 by the droplet ejection portion 30.

<Configuration of Drying Unit>

The drying portion 40 is constituted by a drying unit 4A which has at least an irradiation portion 50, a supply portion 60, an absorption portion 70 and a suction guide unit 80A as illustrated in FIG. 1 to FIG. 3.

The irradiation portion 50 is a part where the continuous paper 9 which has passed through the droplet ejection portion 30 and which is being fed in the feeding direction A is irradiated with laser light for evaporating moisture of ink droplets.

The irradiation portion 50 is constituted by a laser light source 51 for irradiation with laser light, a cooling unit 54 for cooling the laser light source 51, etc.

As the laser light source 51 of those member, any light source may be used as long as it can radiate required laser light suitable for drying. In Exemplary Embodiment 1, for example, a VCSEL (Vertical Cavity Surface Emitting Laser) type unit is used as the laser light source 51.

In addition, the laser light source 51 is designed to radiate the laser light to all the region of the continuous paper 9 in use in a widthwise direction B crossing the feeding direction A of the continuous paper 9. In addition, the laser light source 51 has a light emission surface 52 in a part (lower surface portion in this example) facing the continuous paper 9. The light emission surface 52 has width W2 equal to or a little larger than width W1 of the continuous paper 9 in the widthwise direction B. For example, a glass plate is disposed on the light emission surface 52. Further, the laser light source 51 is disposed so that the light emission surface 52 is spaced at a required interval from the continuous paper 9.

For example, a water-cooling jacket is used as the cooling unit 54. The cooling unit 54 may be omitted if it is not necessary to cool the laser light source 51.

The laser light source 51, the cooling unit 54, the glass plate forming the light emission surface 52, etc. are retained by a retention member 53. For example, the retention member 53 retains the laser light source 51, the cooling unit 54, the glass plate, etc. so as to surround side surface portions thereof.

The supply portion 60 is a part that supplies air toward the space between the irradiation portion 50 and the continuous paper 9 from a position on the downstream side of the irradiation portion 50 in the feeding direction A of the continuous paper 9.

The supply portion 60 is constituted by a supply duct 61, an air blowing unit 66, a connection pipe 67, etc. The supply duct 61 is disposed on the downstream side of the irradiation portion 50 in the feeding direction A of the continuous paper 9. The air blowing unit 66 generates required air and sends the air to the supply duct 61. The connection pipe 67 connects the supply duct 61 and the air blowing unit 66 to each other so that the air generated in the air blowing unit 66 is sent to the supply duct 61.

The supply duct 61 is a hollow structure, which is disposed to be close to the continuous paper 9. In addition, in the supply duct 61, an outlet 62 from which the air is blown out is provided at an end portion closer to the continuous paper 9. Further, the supply duct 61 is connected to the connection pipe 67 substantially at a central portion of an opposite end portion to the continuous paper 9.

The air blowing unit 66 is, for example, disposed in a part of the housing 11. The air blowing unit 66 takes in outside air to generate required air, and sends the air toward the supply duct 61.

The absorption portion 70 is a part that is located on the upstream side of the irradiation portion 50 in the feeding direction A of the continuous paper 9 so as to absorb at least a part of the air flowing along the continuous paper 9 and toward the upstream side in the feeding direction A thereof.

The absorption portion 70 is constituted by an absorption duct 71, a suction unit 76, a connection pipe 77, etc. The absorption duct 71 is disposed on the upstream side of the irradiation portion 50 in the feeding direction A of the continuous paper 9. The suction unit 76 sucks the air to generate a required suction force in the absorption duct 71. The connection pipe 77 connects the absorption duct 71 and the suction unit 76 to each other so that the suction force generated in the suction unit 76 acts on the absorption duct 71.

The absorption duct 71 is a hollow structure, which is disposed to be close to the continuous paper 9. In addition, in the absorption duct 71, an inlet 72 from which the air is sucked is provided at an end portion closer to the continuous paper 9. Further, the absorption duct 71 is connected to the connection pipe 77 substantially at a central portion of an opposite end portion to the continuous paper 9.

The absorption unit 76 is disposed in a part of the housing 11 of the image forming portion 10 so that the sucked air is discharged to the outside of the housing 11.

In accordance with necessity, the absorption portion 70 may be provided with a filter portion 78 or a moisture absorption portion 79 in a required position of the connection pipe 77 or the like, as shown by the alternate long and two short dashes line in FIG. 2. The filter portion 78 captures unnecessary objects included in the sucked air. The moisture absorption portion 79 absorbs moisture included in the sucked air. When the filter portion 78 or the moisture absorption portion 79 is provided thus, the air absorbed in the absorption duct 71 of the absorption portion 70 may be, for example, sent to the air blowing unit 66 of the supply portion 60 or the like so as to be reused therein.

The suction guide unit 80A is a unit that sucks the continuous paper 9 to bring the continuous paper 9 into contact therewith and guides the continuous paper 9 in a position on the opposite side to the irradiation portion 50 with respect to the continuous paper 9 so that the continuous paper 9 is passed through the drying portion 40.

The suction guide unit 80A in Exemplary Embodiment 1 is constituted by a contact guide portion 81A, a suction unit 83, a connection pipe 84, etc. The suction unit 83 sucks the air to generate a required suction force in the contact guide portion 81A. The connection pipe 84 connects the contact guide portion 81A and the suction unit 83 to each other so that the suction force generated in the suction unit 83 acts on the contact guide portion 81A.

The contact guide portion 81A is a part including a contact guide surface 81*s* with which the sucked continuous paper 9 is brought into contact and guided to pass through.

As illustrated in FIG. 2 and so on, the contact guide portion 81A is designed to bring the continuous paper 9 into contact with the flat contact guide surface 81*s* to thereby guide the continuous paper 9 in an opposite position to the irradiation portion 50 with respect to the continuous paper 9 and in a position corresponding to at least a part of a region R extending from an irradiation range S of the laser light radiated from the irradiation portion 50 to the outlet 62 of the supply portion 60.

Here, the irradiation range S of the laser light is a range where the laser light having been emitted from the laser light source 51 of the irradiation portion 50 and having passed through the light emission surface 52 is actually radiated onto the one surface of the continuous paper 9 which is passing at a predetermined interval from the light emission surface 52. More specifically the irradiation range S is, for example, a range covering positions displaced slightly on the upstream side and the downstream side from a front end portion 52*c* and a rear end portion 52*d* of the light emission surface 52 in the feeding direction A of the continuous paper 9. The outlet 62 of the supply portion 60 is at a position P2 of an opening edge of the outlet 62 located on the most upstream side in the feeding direction A of the continuous paper 9.

The region R corresponds to a region extending between an irradiation upstream end P1 of the irradiation range S in the feeding direction A of the continuous paper 9 and the position P2 of the outlet 62 of the supply portion 60.

In addition, the contact guide portion 81A is disposed so that the contact guide surface 81*s* thereof is disposed in a position corresponding to the irradiation range S of the laser light from the irradiation portion 50 with respect to the feeding direction A of the continuous paper 9, and located, with respect to the widthwise direction B of the irradiation portion 50, in a position slightly protruding outward from opposite end portions 9*a* and 9*b* of the continuous paper 9 in the widthwise direction B (that is, opposite end portions 50*a* and 50*b* of the irradiation portion 50 in the widthwise direction B), as illustrated in FIG. 2, FIG. 3, etc. For example, a rectangular flat surface having length corresponding to the irradiation range S of the laser light and width W3 a little larger than the width W1 of the continuous paper 9 is used as the contact guide surface 81*s*, as illustrated in FIG. 3 or FIG. 5.

Figure 4:
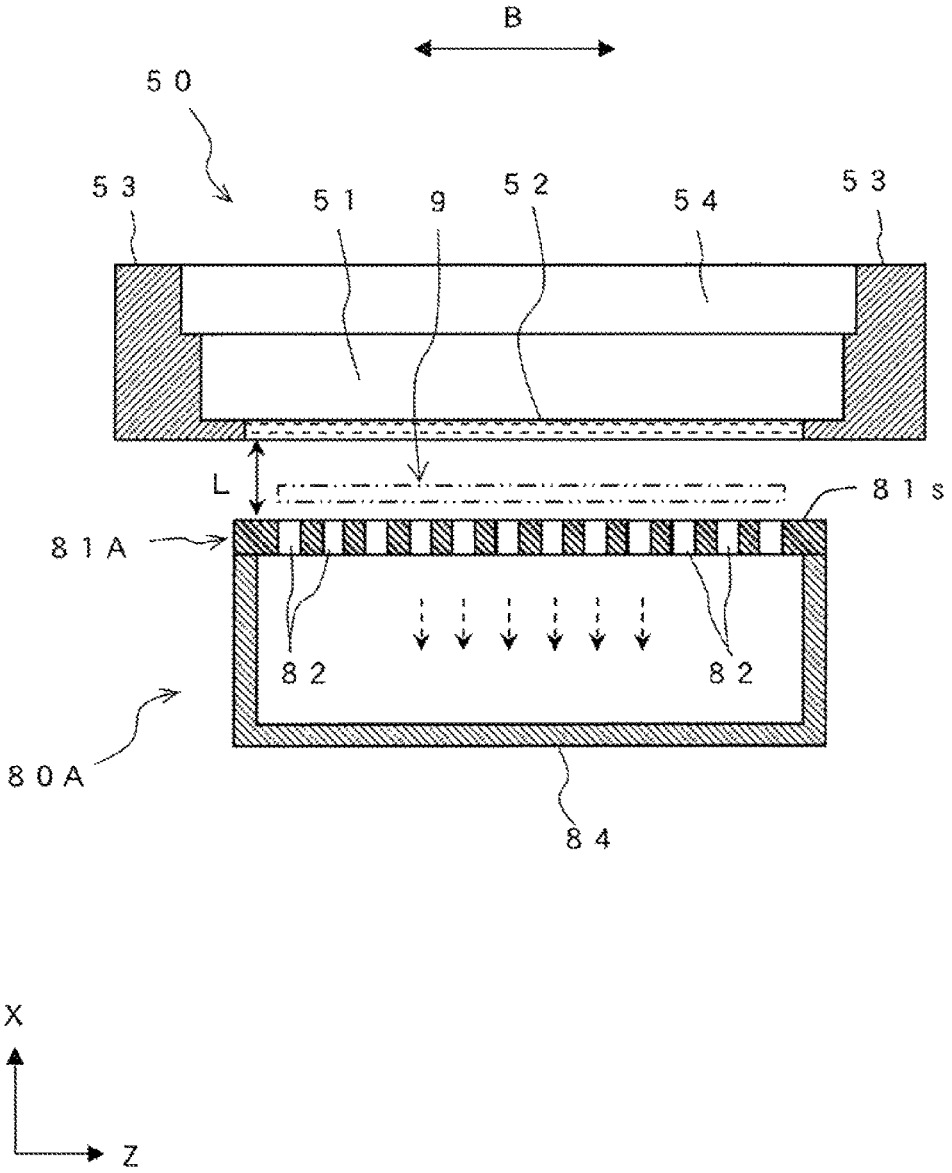
FIG. 4 is a schematic end face view of the drying unit taken on line Q1-Q1 in FIG. 3.

The contact guide portion 81A is disposed so that the contact guide surface 81*s* thereof is retained at a predetermined distance L from the light emission surface 52 of the irradiation portion 50, as illustrated in FIG. 4 and so on.

Figure 5:
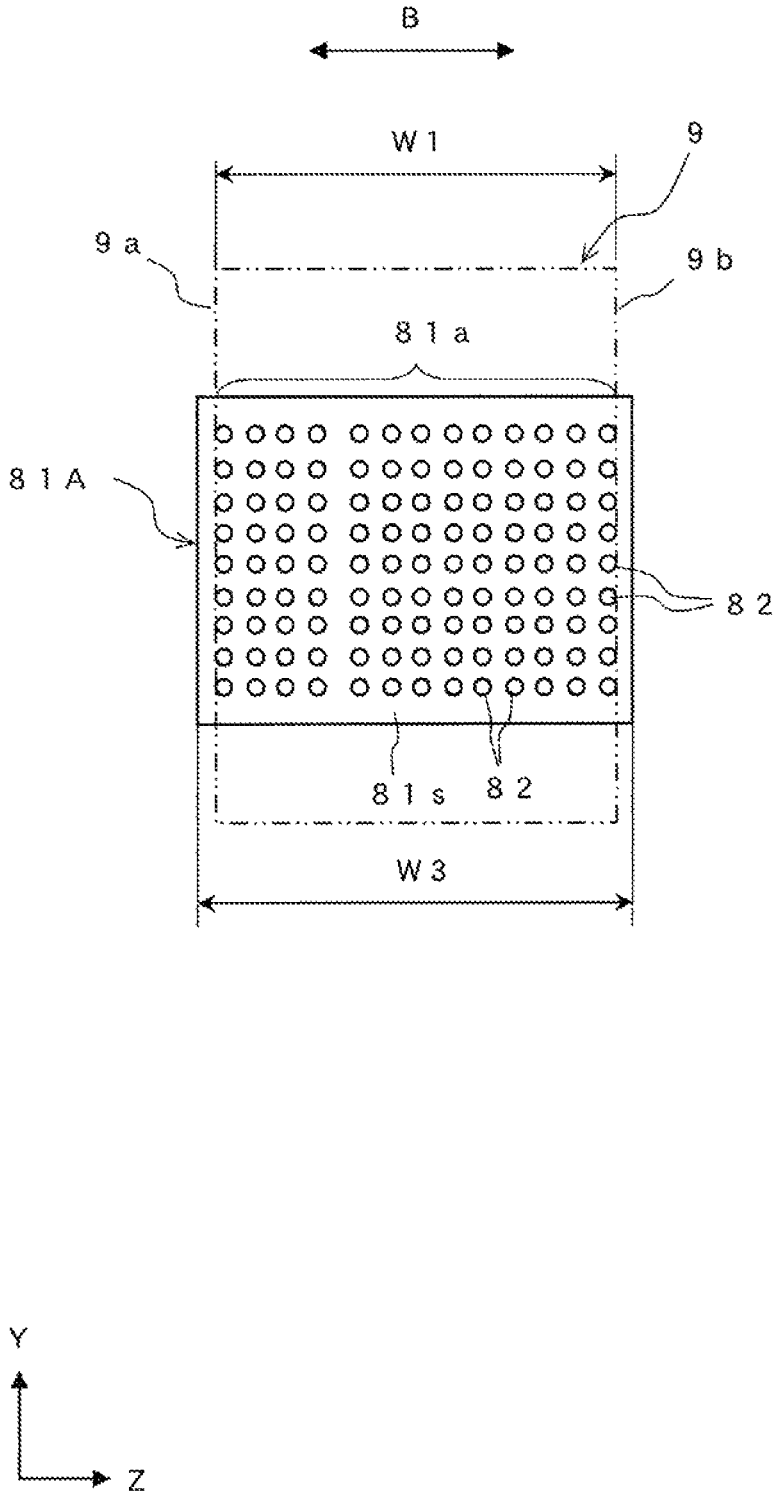
FIG. 5 is a conceptual view illustrating a contact guide portion of the drying unit in FIG. 2, which is observed laterally.

Further, the contact guide portion 81A is formed out of a member like a flat plate or the like with suction holes 82, as illustrated in FIG. 2, FIG. 4, FIG. 5, etc.

The suction holes 82 are openings that allow the suction force to act on the continuous paper 9. A plurality of suction holes 82 disposed and dispersed almost uniformly in the feeding direction A and the widthwise direction B of the continuous paper 9 are used as the suction holes 82 in Exemplary Embodiment 1. In addition, the suction holes 82 are disposed to be located up to, of a region 81*a* of the contact guide portion 81A along the widthwise direction B of the continuous paper 9, positions substantially corresponding to the opposite end portions 9*a* and 9*b* of the continuous paper 9, as illustrated in FIG. 4.

In addition, a member having a physical property of absorbing, of the laser light radiated from the irradiation portion 50, at least laser light passing through the continuous paper 9 is used as the member forming the contact guide portion 81A. For example, a member having at least a part made of a material such as aluminum, nickel plating or the like is used as the member forming the contact guide portion 81A.

The suction unit 83 is a device such as a suction fan, which is disposed in a part of the housing 11 of the image forming portion 10 so as to suck air to thereby generate a required suction force on the contact guide portion 81A side. In addition, the suction unit 83 discharges the sucked air to the outside of the housing 11 finally. The required suction force may be, for example, a suction force with which the continuous paper 9 can be sucked on the contact guide surface 81*s* of the contact guide portion 81A and brought into contact with the contact guide surface 81*s*, and the continuous paper 9 can be fed in the feeding direction A without being disturbed while keeping the contact with the contact guide surface 81.

One end portion 84*a* of the connection pipe 84 is connected to a part of the contact guide portion 81A opposite to the contact guide surface 81*s*, and the other end portion 84*b* is connected to the suction unit 83 or a part (outlet) of the housing 11 through the suction unit 83, as illustrated in FIG. 2, FIG. 4, etc. As a matter of convenience, the connection pipe 84 shown in FIG. 2 has a configuration in which the connection pipe 84 is disposed to extend in a direction leaving the contact guide portion 81A on the opposite side to the irradiation portion 50 and then extend in the feeding direction A of the continuous paper 9. However the connection pipe 84 is not limited to this configuration at all.

In the image forming portion 10, when (the suction unit 83 of) the contact guide portion 81A is not operated to suck the air, the continuous paper 9 is kept in a state of noncontact with the contact guide surface 81*s* of the contact guide portion 81A, and kept to be fed in a state where the distance from the contact guide surface 81*s* increases gradually as the continuous paper 9 goes farther on the downstream side in the feeding direction A thereof, as illustrated by the alternate long and two short dashes line in FIG. 5 by way of example.

<Operation of Droplet Ejection Device and Drying Unit>

In the droplet ejection device 1, the image forming portion 10, the feeding portion 20 and the take-up portion 25 are activated as soon as a not-shown control portion receives an instruction of an operation request to form an image.

As a result, the continuous paper 9 is fed out from the feeding portion 20 and sent into the image forming portion 10, while the continuous paper 9 having passed through the image forming portion 10 is taken up around the take-up portion 25.

On this occasion, in the image forming portion 10, the droplet ejection portion 30 ejects ink droplets of predetermined colors respectively from required ones of the ink recording heads 32 (Y, M, C and K) to one surface of the continuous paper 9 which is being fed and passed therethrough, in accordance with information of an image.

As a result, ink droplets 35 (FIG. 6) of the ejected colors and mixed colors are attached to the one surface of the continuous paper 9 so as to form the image. Thus, the image is formed out of the inks.

Next, in the image forming portion 10, the continuous paper 9 is fed to pass through the drying portion 40.

On this occasion, in the drying unit 4A of the drying portion 40, a suction force caused by the suction of the air acts on the contact guide surface 81*s* of the contact guide portion 81A through the suction holes 82 due to the operation of (the suction unit 83 of) the suction guide unit 80A. Accordingly, the continuous paper 9 is fed in. contact with the contact guide surface 81*s* due to the suction as illustrated in FIG. 6 or FIG. 7.

As a result, the continuous paper 9 is fed in contact with the flat contact guide surface 81*s* in the contact guide portion 81A. Thus, the continuous paper 9 moves keeping a substantially fixed interval from the light emission surface 52 of the irradiation portion 50.

In addition, on this occasion, in the drying unit 4A, the continuous paper 9 to which the ink droplets 35 ejected from the droplet ejection portion 30 have been attached and which is being fed by the guide of the contact guide portion 81A is irradiated with laser light from the laser light source 51 of the irradiation portion 50.

Figure 6:
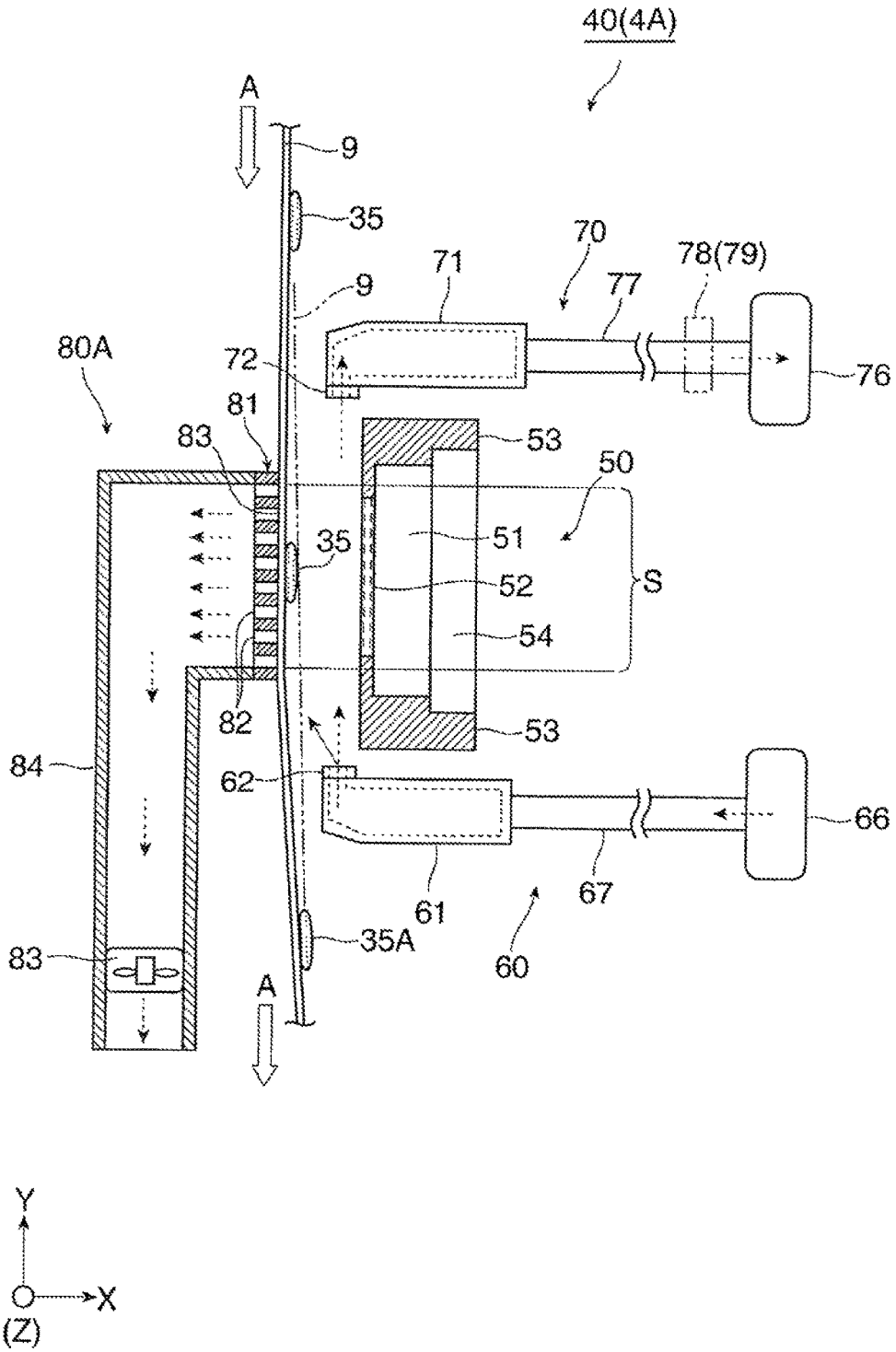
FIG. 6 is a conceptual view illustrating an operating state of the drying unit in FIG. 2.
Figure 7:
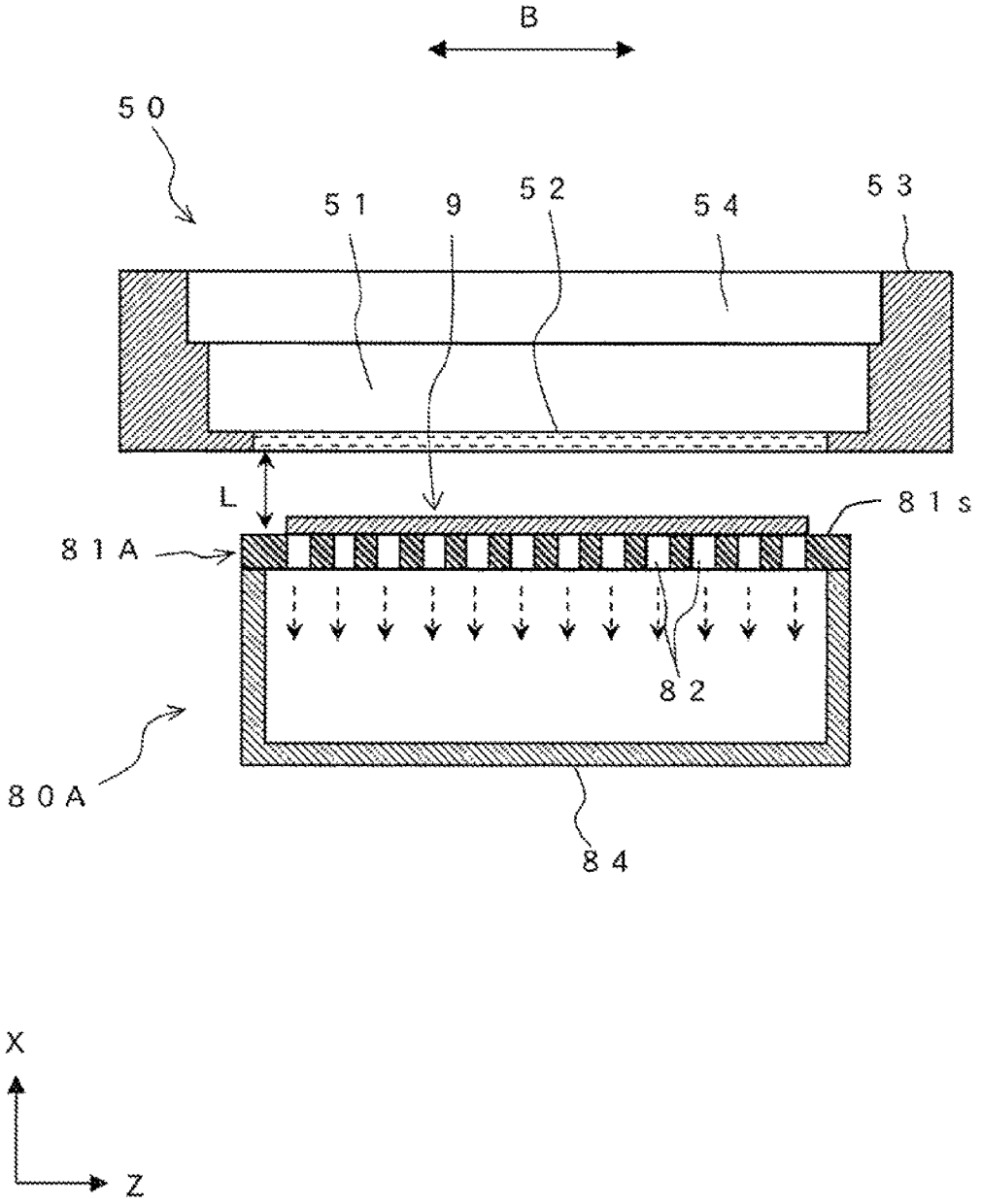
FIG. 7 is a conceptual view illustrating an operating state of the drying unit in FIG. 3, which is shown by a cut end face along the line Q1-Q1.

In addition, in the drying unit 4A, as illustrated in FIG. 6, the supply duct 61 in the supply portion 60 supplies air (arrow of a broken line) from the outlet 62 thereof toward the space between the irradiation portion 50 and the continuous paper 9. Further, the absorption duct 71 in the absorption portion 70 absorbs at least a part (arrow of a broken line) of the air flowing along the continuous paper 9 from the inlet 72 thereof to the upstream in the feeding direction A.

Consequently, of each ink droplet 35 attached to the continuous paper 9, moisture included in the ink thereof is evaporated due to instantaneous temperature rise to a boiling temperature by the irradiation with the laser light from the irradiation portion 50.

As a result, bleeding from permeation of moisture caused by the adhesion of the ink droplet 35 may be reduced in the continuous paper 9. Thus, an image is formed from an ink (color material) 35A where moisture has been evaporated, as illustrated in FIG. 6.

In addition, in the drying unit 4A, air supply by the supply portion 60 and air absorption by the absorption portion 70 are performed on the upstream side and the downstream side in the feeding direction A of the continuous paper 9 with respect to the irradiation portion 50. Thus, an air flow (see FIG. 6) flowing on the upstream in the feeding direction of the continuous paper 9 is formed in the space between the irradiation portion 50 and the continuous paper 9 where irradiation with laser light is performed.

As a result, moisture of each ink droplet 35 is evaporated due to the irradiation with the laser light. Water vapor floating on the continuous paper 9 is removed from the continuous paper 9 and conveyed by the air flow flowing to the upstream in the feeding direction A, while the water vapor is absorbed together with the air of the air flow by the absorption duct 71 of the absorption portion 70. On this occasion, the air including the water vapor and absorbed by the absorption portion 70 is discharged to the outside of the housing 11 finally.

Accordingly, in the drying unit 4A, the water vapor generated from the evaporated moisture of the ink droplet 35 is suppressed from staying in the space between the irradiation portion 50 and the continuous paper 9. Thus, the continuous paper 9 having passed through the drying unit 4A is in a dried state. In addition, in the drying unit 4A, the water vapor is suppressed or prevented from adhering to the continuous paper 9 again, or the water vapor is suppressed or prevented from adhering to the light emission surface 52 or the retention member 53 of the irradiation portion 50 and there forming into dew drops.

In addition, in the drying unit 4A, the continuous paper 9 may be shaken and waved on the downstream side of the irradiation portion 50 in the feeding direction A by the air supplied and blown from the outlet 62 of the supply duct 61 in the supply portion 60.

However, in the drying unit 4A, as illustrated in FIG. 6 or FIG. 7, the continuous paper 9 is sucked on (the contact guide surface 81*s* of) the contact guide portion 81A of the suction guide unit 80A and fed in contact therewith. Consequently, even if the continuous paper 9 is shaken by the air blown in the supply portion 60, the shaking may be suppressed substantially to disappear due to the contact with the contact guide portion 81A of the suction guide unit 80A.

As a result, when the continuous paper 9 is passing through the irradiation range S of the laser light in the irradiation portion 50, the continuous paper 9 moves in contact with (the flat contact guide surface 81*s* of) the contact guide portion 81A disposed in a position corresponding to the irradiation range S, so that the continuous paper 9 is subjected to the irradiation with the laser light in a substantially fixed state (such as intensity of the irradiation) while moving keeping a substantially fixed interval from the light emission surface 52 of the irradiation portion 50. Thus, in the drying unit 4A, the continuous paper 9 is dried in good condition without drying unevenness.

Figure 19:
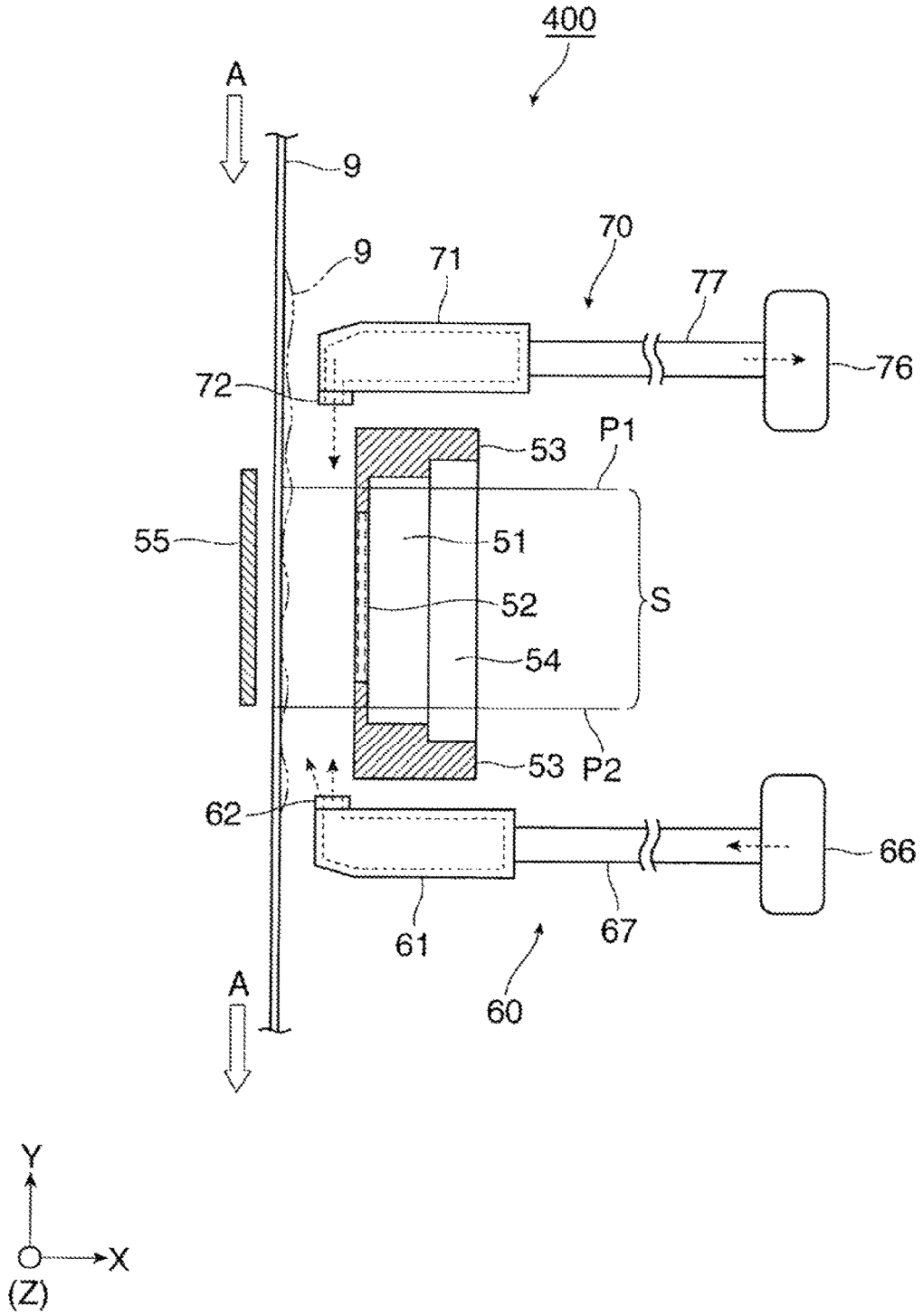
FIG. 19 is a conceptual view illustrating a configuration of a drying unit for comparison.

In contrast to the drying unit 4A, in a case of a drying unit 400 which does not have the suction guide unit 80A in the drying unit 4A, the air supplied from the outlet 62 of the supply portion 60 is blown to the continuous paper 9 so that the continuous paper 9 may be shaken and waved as drawn by the alternate long and two short dashes curve as shown in FIG. 19 by way of example. The reference numeral 55 in FIG. 19 is similar to a light shielding portion which will be described later in Exemplary Embodiment 2.

The shaking of the continuous paper 9 occurs more conspicuously as the rate (volume) of the air suppled from the outlet 62 of the supply portion 60 is increased, for example, in order to accelerate drying the continuous paper 9. In addition, if the continuous paper 9 is shaken when passing through the irradiation portion 50, the condition such as intensity of the laser light radiated to the continuous paper 9 may be dispersed due to a variation in the distance between the continuous paper 9 and the light emission surface 52 of the irradiation portion 50. Thus, uneven drying may bring about finally.

In addition, in the drying unit 4A, the contact guide portion 81A in the suction guide unit 80A is formed out of a member having a physical property of absorbing the laser light. Accordingly, even if a part of the laser light passes through the continuous paper 9 when the laser light is radiated from the irradiation portion 50, the laser light passing through the continuous paper 9 may be absorbed or blocked by the contact guide portion 81A.

As a result, the laser light passing through the continuous paper 9 may be also suppressed from being unintentionally radiated to any other part of the image forming portion 10.

Modified Example of Exemplary Embodiment 1

Figure 8:
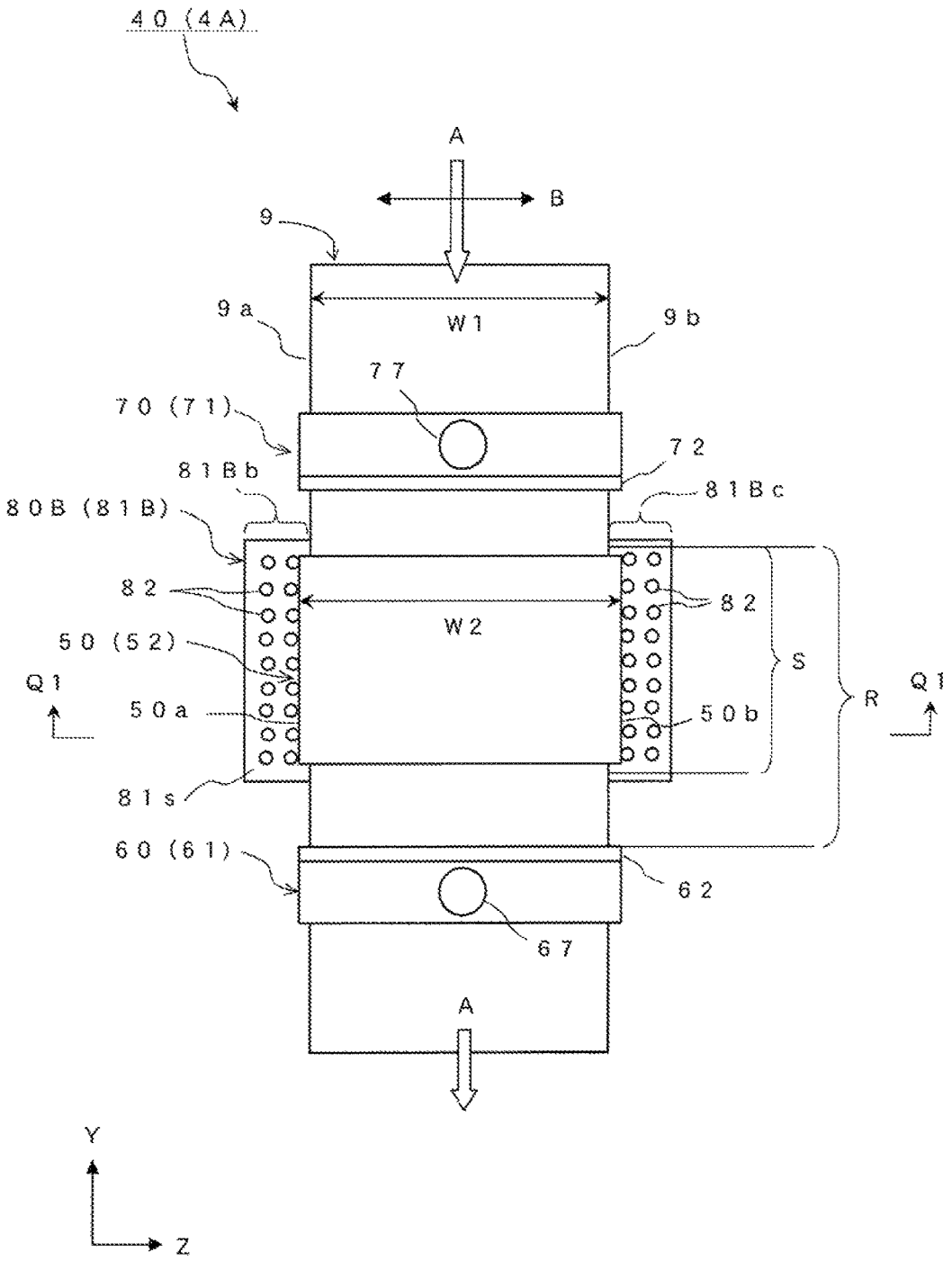
FIG. 8 is a conceptual view illustrating a modified example of the drying unit in FIG. 2, which is observed laterally.
Figure 9:
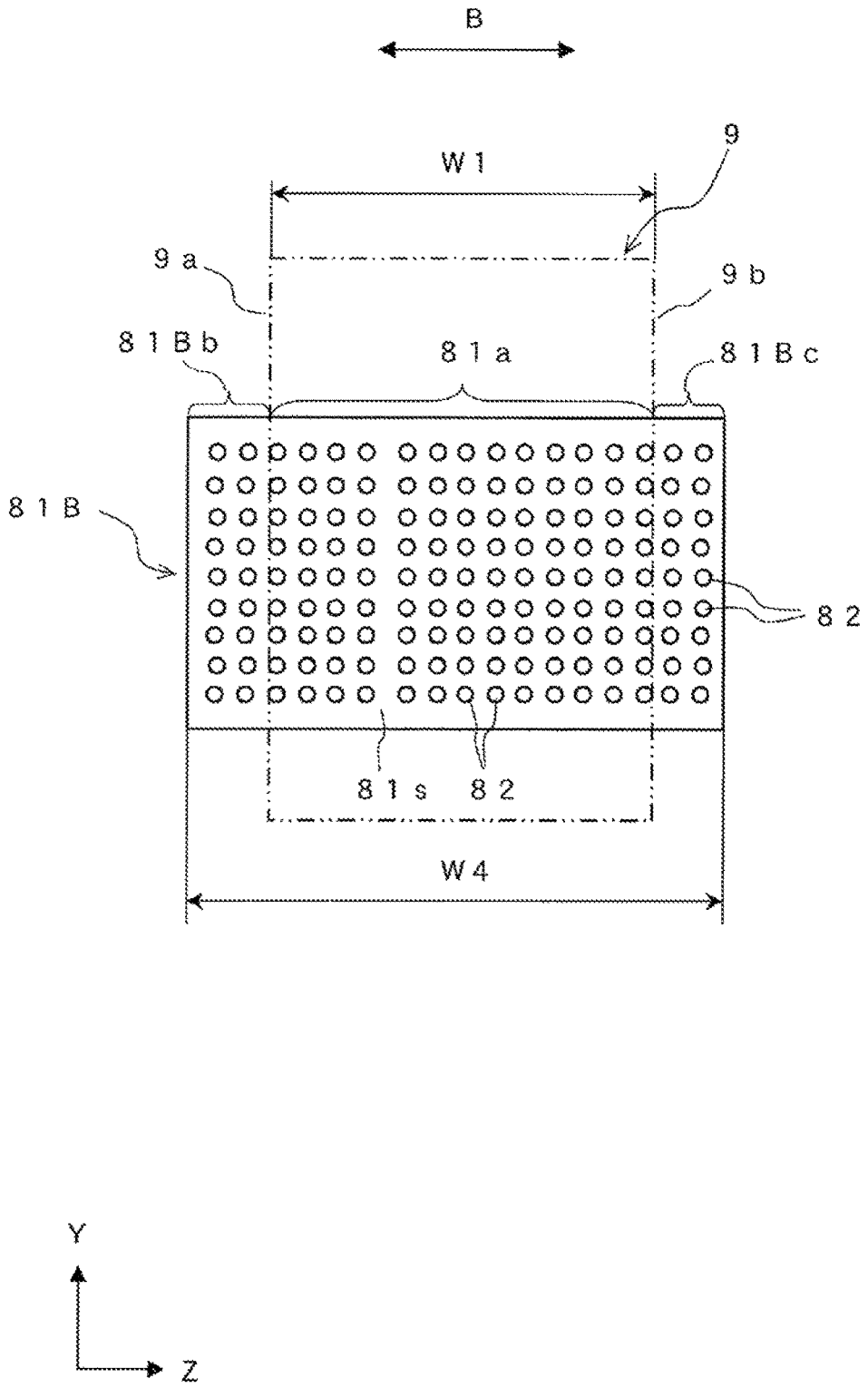
FIG. 9 is a conceptual view illustrating a contact guide portion of the drying unit in FIG. 8, which is observed laterally.

FIG. 8 and FIG. 9 illustrate a modified example of the drying unit 4A according to Exemplary Embodiment 1.

The drying unit 4A in the modified example has the same configuration as the drying unit 4A according to Exemplary Embodiment 1, except that the suction guide unit 80A is replaced by a suction guide unit 80B having a partially different configuration therefrom.

In the suction guide unit 80B in the modified example, a contact guide portion 81B is used as a contact guide portion thereof. In the contact guide portion 81B, suction holes 82 are provided so that some of the suction holes 82 are also located in positions outside the opposite end portions 9*a* and 9*b* of the continuous paper 9, as illustrated in FIG. 8 or FIG. 9.

That is, in the contact guide portion 81B, as illustrated in FIG. 9, in addition to the suction holes 82 provided in the region 81*a* corresponding to the width W1 of the continuous paper 9, the suction holes 82 are also provided in protruding regions 81Bb and 81Bc protruding outside the opposite end portions 9*a* and 9*b* of the continuous paper 9. Accordingly, the contact guide portion 81B has width W4 larger than the width W1 of the continuous paper 9 due to the addition of the protruding regions 81Bb and 81Bc.

Figure 10:
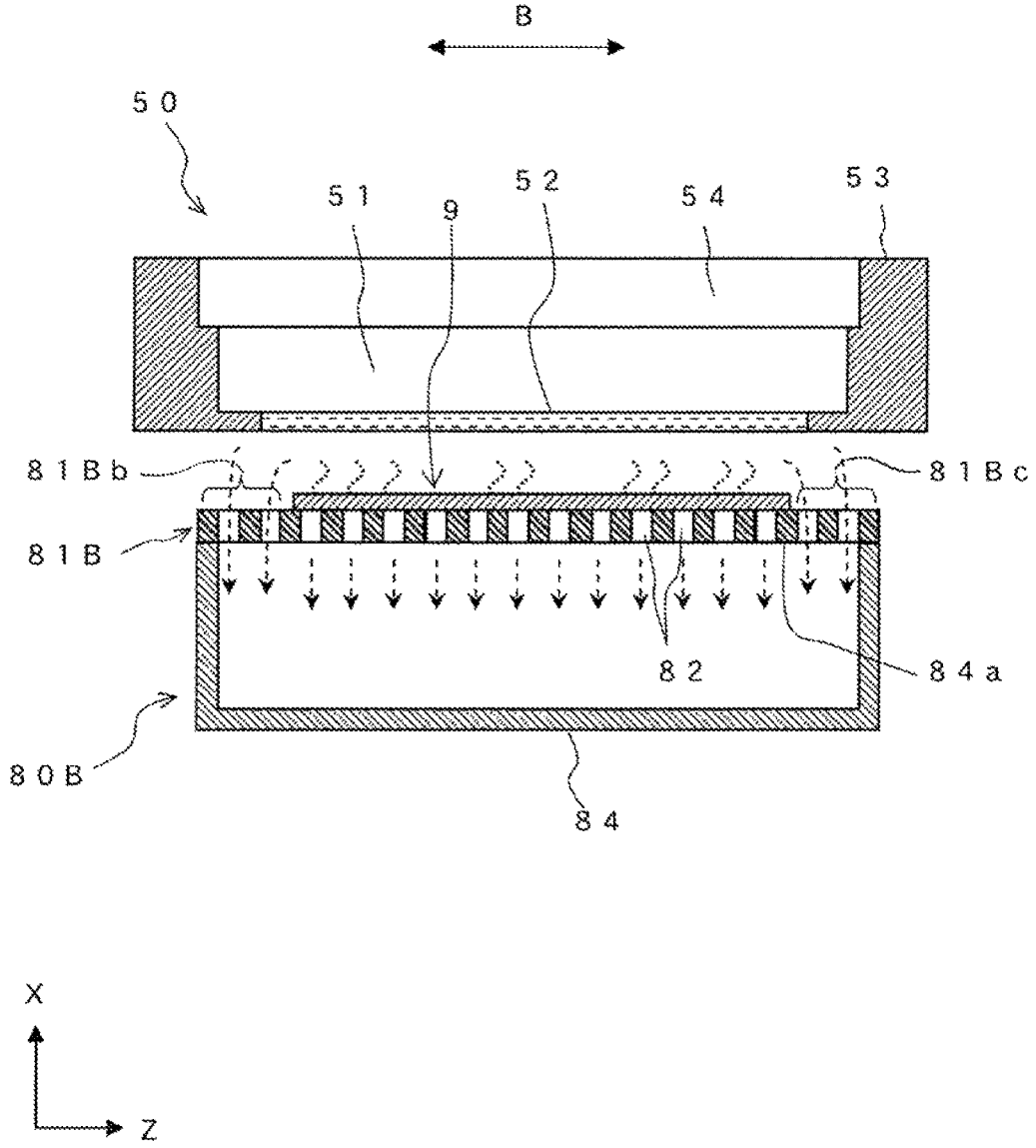
FIG. 10 is a conceptual view illustrating an operating state of the drying unit in FIG. 8, which is shown by the cut end face along the line Q1-Q1.

In addition, the suction guide unit 80B is designed so that an end portion 84*a* of the connection pipe 84 connected to the contact guide portion 81B is also connected to the protruding regions 81Bb and 81Bc of the contact guide portion 81B as illustrated in FIG. 10.

<Operation of Drying Unit>

The droplet ejection device 1 provided with the drying unit 4A according to the modified example operates in the same manner as the droplet ejection device 1 provided with the drying unit 4A (suction guide unit 80A) according to Exemplary Embodiment 1, except that the following effects are additionally provided on the continuous paper 9 passing through the drying unit 4A as will be described below.

In the drying unit 4A according to the modified example, a suction force caused by suction of air acts on the contact guide surface 81*s* of the contact guide portion 81B through the suction holes 82 due to the operation of (the suction unit 83 of) the suction guide unit 80B. Thus, as illustrated in FIG. 10, the continuous paper 9 may be sucked on the inside region 81*a* of the contact guide surface 81*s* excluding the protruding regions 81Bb and 81Bc so as to be fed in contact therewith in the same manner as in the case of the operation in Exemplary Embodiment 1.

In addition thereto, in the drying unit 4A, as illustrated in FIG. 10, the protruding regions 81Bb and 81Bc where the continuous paper 9 is absent and the suction holes 82 are exposed appear in the contact guide surface 81*s* of the contact guide portion 81B. Thus, of high-humidity air including water vapor (the broken curve in FIG. 10) generated by evaporation of moisture in each ink droplet 35 due to the irradiation with the laser light from the irradiation portion 50, the high-humidity air near the opposite end portions 9*a* and 9*b* of the continuous paper 9 or the high-humidity air that is going to spread outward from the opposite end portions 9*a* and 9*b* may be absorbed through the suction holes 82 in the protruding regions 81Bb and 81Bc by the suction guide unit 80B.

As a result, in the drying unit 4A, the high-humidity air including water vapor generated by evaporation of moisture in each ink droplet due to the irradiation with the laser light from the irradiation portion 50 may not only be absorbed to ride on the air flow formed by the air supply of the supply portion 60 and removed by the air suction of the absorption portion 70 but also may be absorbed and removed by the suction guide unit 80B.

Thus, according to the drying unit 4A in the modified example, the water vapor generated by the evaporation of the moisture from each ink droplet 35 is more effectively suppressed or prevented from adhering to the continuous paper 9 again, or the water vapor is more effectively suppressed or prevented from adhering to the light emission surface 52 or the retention member 53 of the irradiation portion 50 to thereby generate dew drops.

Exemplary Embodiment 2

Figure 11:
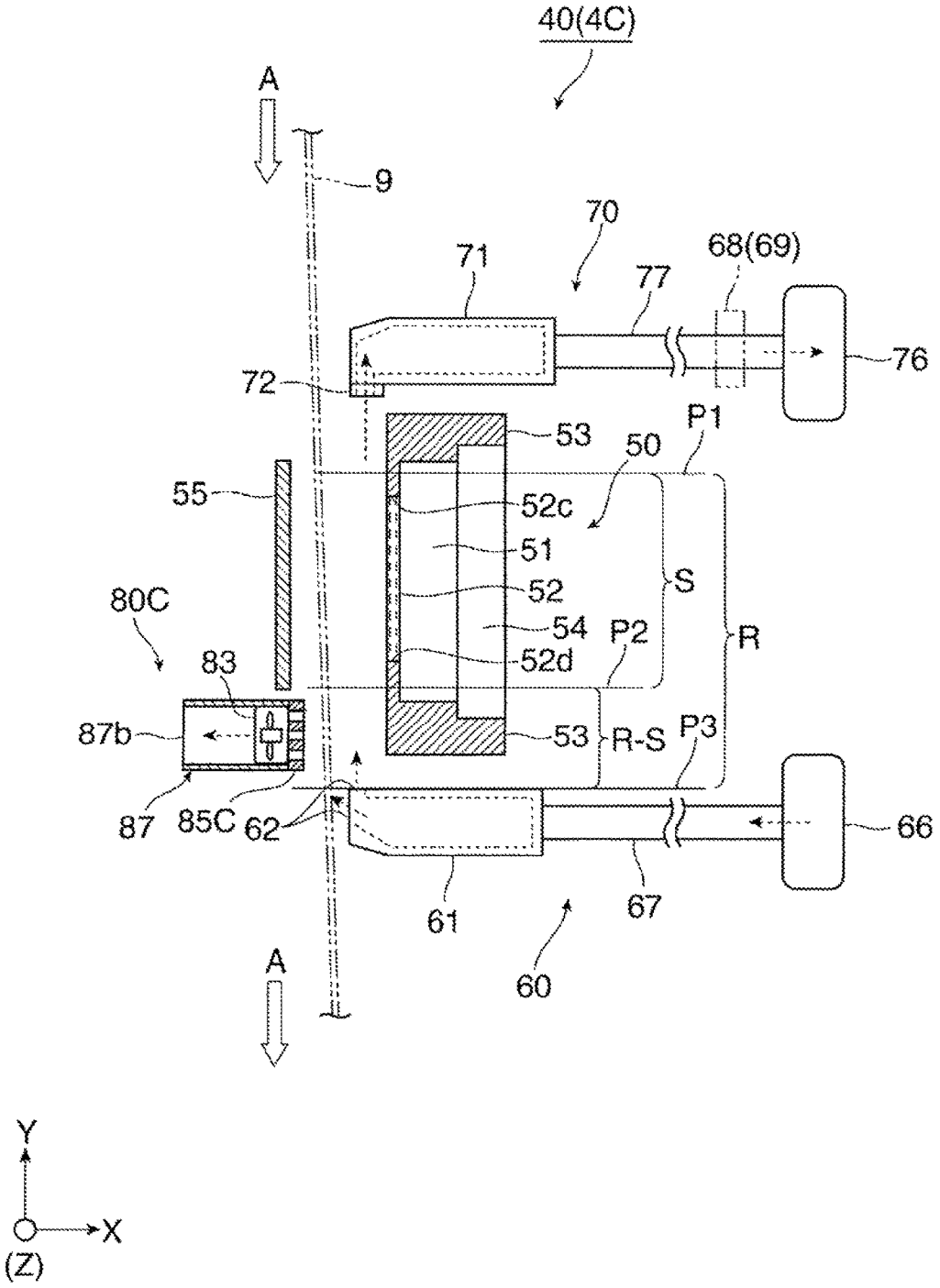
FIG. 11 is a partially sectional conceptual view illustrating a configuration of a drying unit according to Exemplary embodiment 2.
Figure 12:
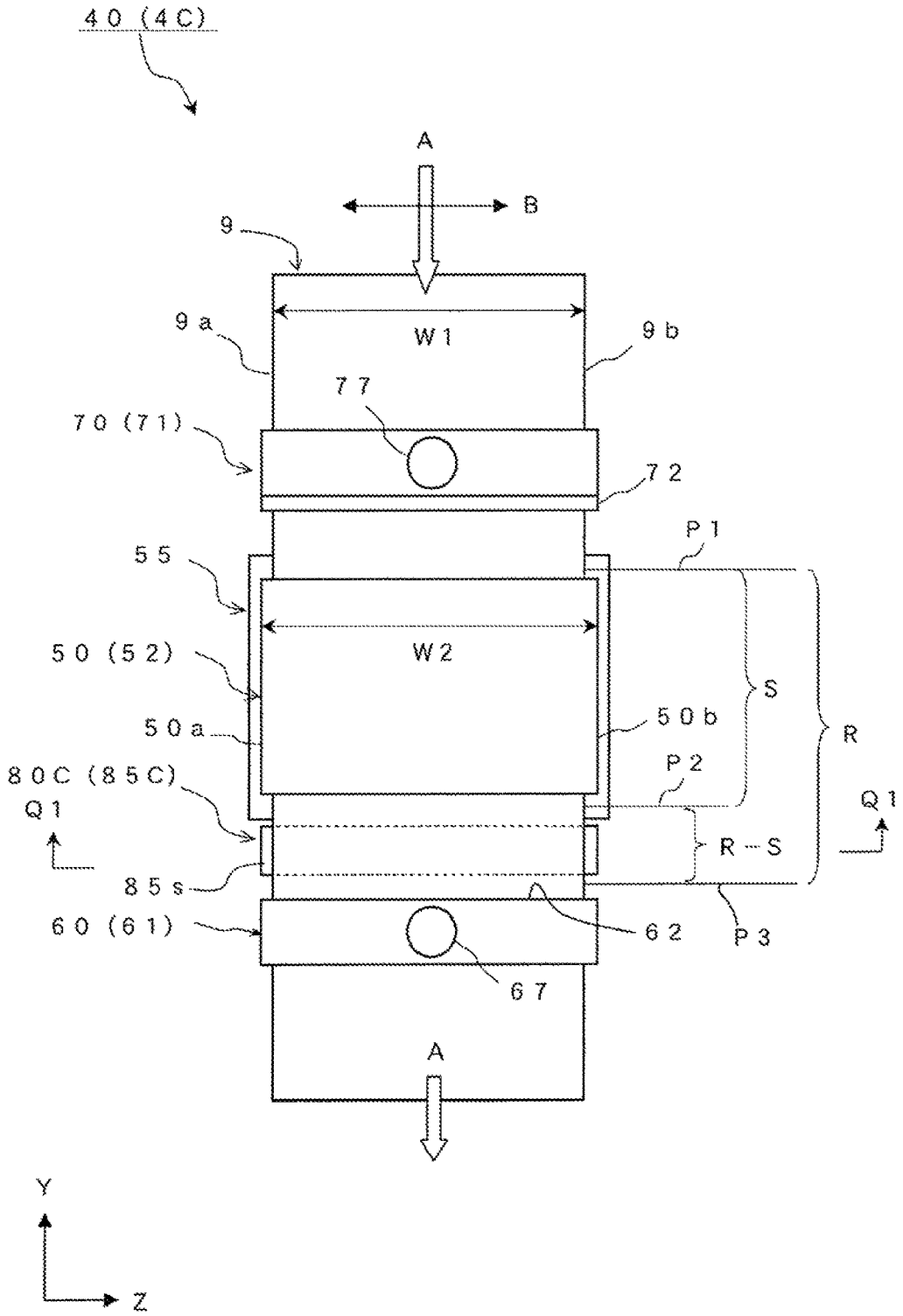
FIG. 12 is a conceptual view illustrating the configuration of the drying unit in FIG. 11, which is observed laterally.

FIG. 11 and FIG. 12 illustrates a drying unit 4C according to Exemplary Embodiment 2.

The drying unit 4C according to Exemplary Embodiment 2 has the same configuration as the drying unit 4A according to Exemplary Embodiment 1, except that the suction guide unit 80A is replaced by a suction guide unit 80C having a partially different configuration therefrom.

In the drying unit 4C, the suction guide unit 80C thereof is constituted by a contact guide portion 85C, a suction unit 83, a discharge pipe 87, etc. The suction unit 83 sucks air to generate a required suction force for the contact guide portion 85C. The air sucked by the suction unit 83 is discharged through the discharge pipe 87.

Among those member, in the contact guide portion 85C, a contact guide surface 85*s* thereof is disposed, with respect to the feeding direction A of the continuous paper 9, in a position corresponding to a part of a region (R-S) where the irradiation range S of laser light is excluded from the aforementioned region R, and with respect to the widthwise direction B of the irradiation portion 50, located to reach positions slightly protruding outside the opposite end portions 9*a* and 9*b* of the continuous paper 9 (that is, the opposite end portions 50*a* and 50*b* of the irradiation portion 50), as illustrated in FIG. 11, FIG. 12, etc. In the feeding direction A, the contact guide portion 85C is disposed in a part of the region (R-S) extending from an irradiation downstream end P2 of the irradiation range S on the downstream side in the feeding direction A of the continuous paper 9 and a position P3 of the outlet 62 of the supply portion 60.

Figure 13:
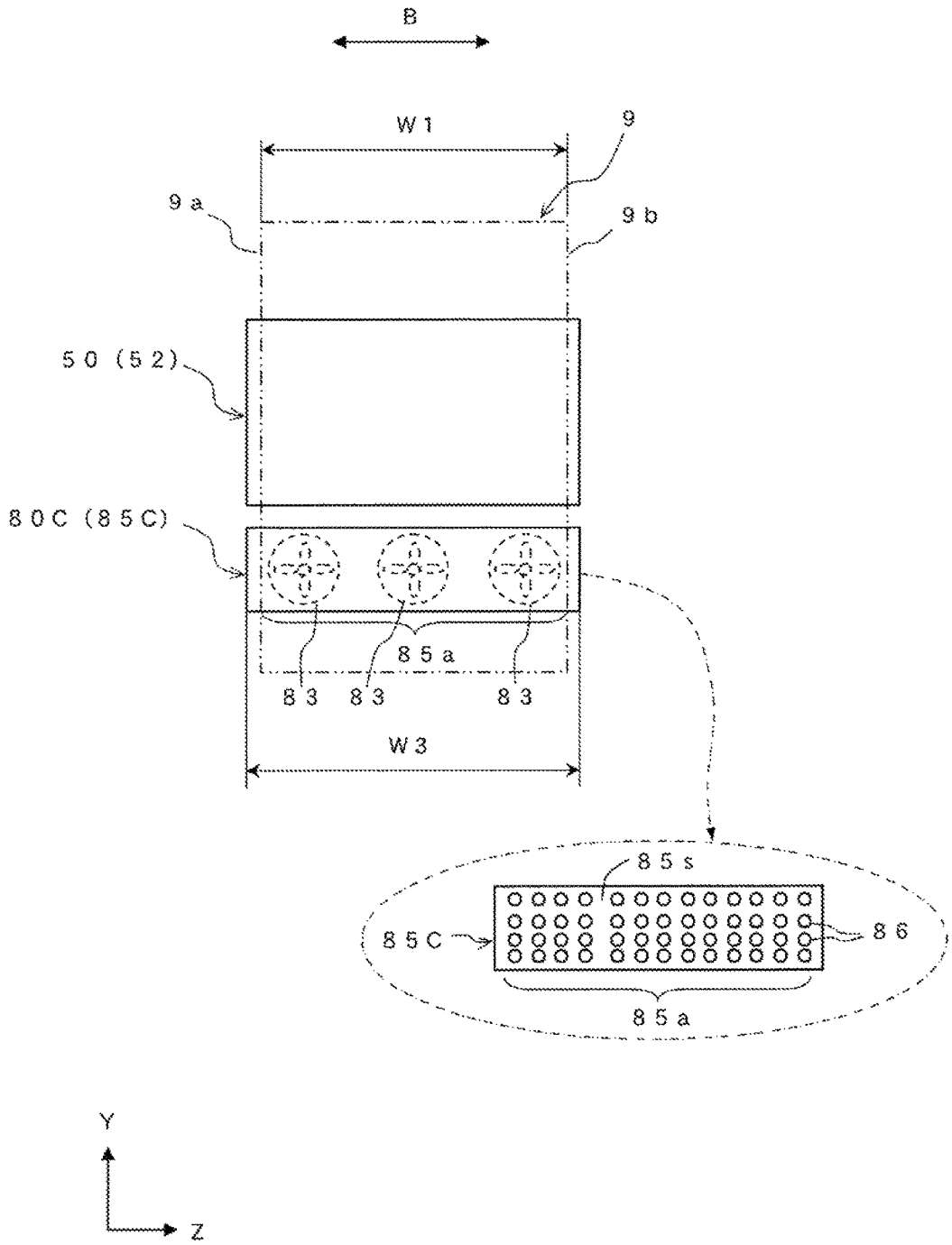
FIG. 13 is a conceptual view illustrating a contact guide portion and an irradiation portion of the drying unit in FIG. 11, which are observed laterally.

A rectangular flat surface having length corresponding to the irradiation range S (FIG. 11) of the laser light and width W3 a little larger than the width W1 of the continuous paper 9 is used as the contact guide surface 85*s* as illustrated in FIG. 13, in the same manner as in the case of the contact guide surface 81*s* in the contact guide portion 81A or 81B.

Figure 14:
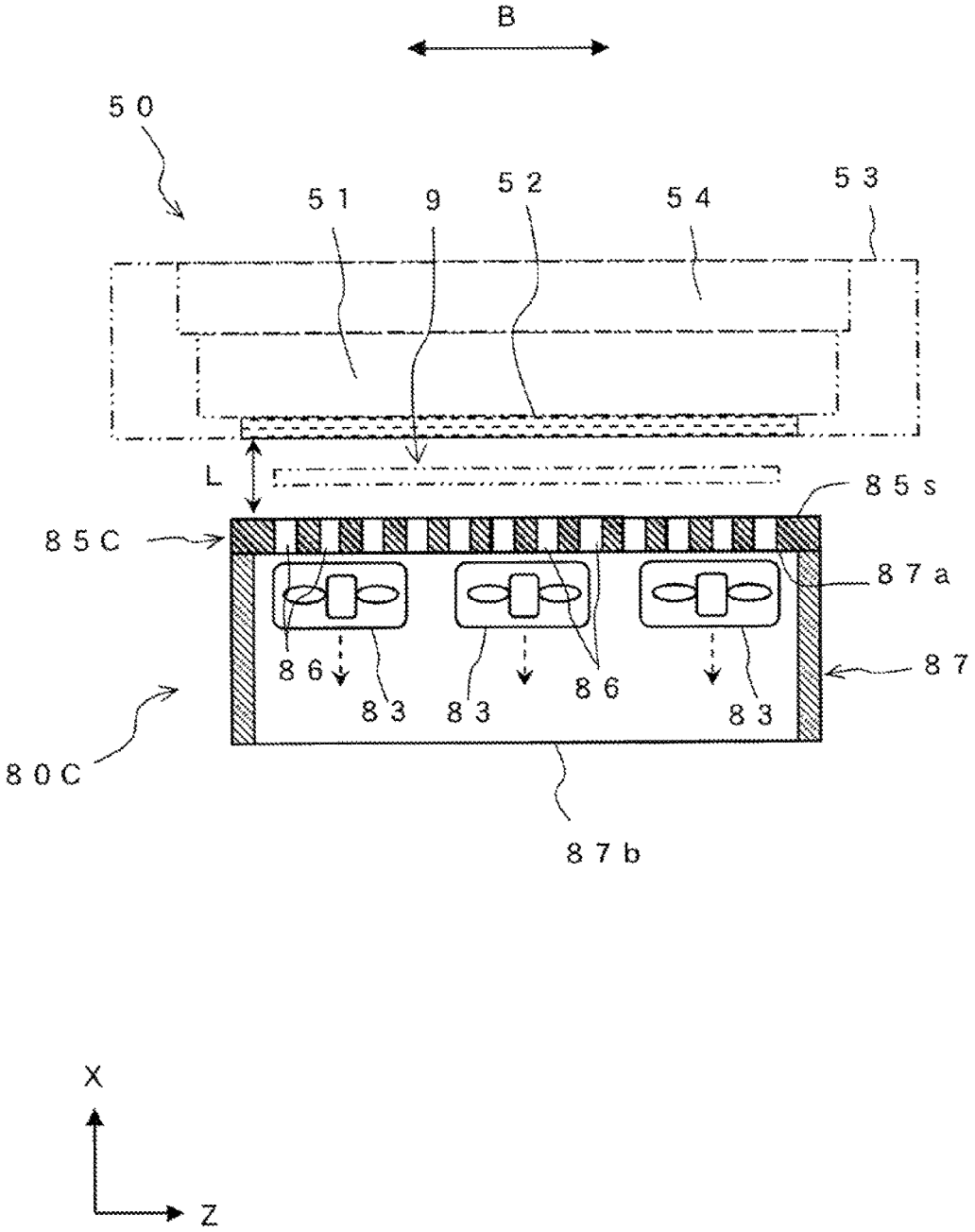
FIG. 14 is a conceptual view illustrating an operating state of the drying unit in FIG. 12, which is shown by a cut end face along a line Q1-Q1.

In addition, the contact guide portion 85C is disposed so that the contact guide surface 85*s* thereof is retained at a predetermined distance L from the height of the light emission surface 52 of the irradiation portion 50 as illustrated in FIG. 14 and so on.

In addition, the contact guide portion 85C is formed out of a member like a flat plate or the like with suction holes 86, as illustrated in FIG. 11 to FIG. 14, etc.

The suction holes 86 are openings that allow the suction force to act on the continuous paper 9 in the same manner as the aforementioned suction holes 82. A plurality of suction holes 86 disposed and dispersed almost uniformly in the feeding direction A and the widthwise direction B of the continuous paper 9 are used as the suction holes 86 in Exemplary Embodiment 2. In addition, the suction holes 86 are disposed to be located up to, of a region 85*a* of the contact guide portion 85C along the widthwise direction B of the continuous paper 9, positions substantially corresponding to the opposite end portions 9*a* and 9*b* of the continuous paper 9, as illustrated in FIG. 13.

Further, a member having a physical property of absorbing the laser light is used as the member forming the contact guide portion 85C in the same manner as in the contact guide portion 81A or 81B according to Exemplary Embodiment 1.

The contact guide portion 85C is not disposed in a position facing the light emission surface 52 of the irradiation portion 50. Accordingly, a member that does not have such a physical property of absorbing the laser light can be used as the member forming the contact guide portion 85C. In addition, an exterior member provided in the absorption unit 83 may be used as the member forming the contact guide portion 85C as long s it can be used as (the contact guide surface 85*s* of) the contact guide portion 85C.

One end portion 87*a* of the discharge pipe 87 is connected to a part of the contact guide portion 85C opposite to the contact guide surface 85*s*, and the other end portion 87*b* is connected to a part (outlet) of the housing 11 through the suction unit 83, as illustrated in FIG. 11, FIG. 14, etc.

For example, three suction units are used as such suction units 83 and disposed to be arranged in a row along the widthwise direction B of the irradiation portion 50. In addition, although each suction unit 83 is disposed inside the one end portion 87*a* side of the discharge pipe 87, the suction unit 83 is not limited to such a configuration at all. For example, the suction unit 83 may be disposed between the contact guide portion 85C and the one end portion 87*a* of the discharge pipe 87.

In addition, in the drying unit 4C, the contact guide portion 85C of the suction guide unit 80C is disposed in a part of the region (R-S) excluding the irradiation range S of the laser light. Accordingly, a light shielding portion 55 that shields or absorbs unnecessary laser light passing through the continuous paper 9 or the like is disposed in a position opposite to the irradiation portion 50 with respect to the continuous paper 9 and in a position including at least the irradiation range S of the laser light, as illustrated in FIG. 11 or FIG. 12.

The light shielding portion 55 is constituted by a member which includes at least a part made of a material such as aluminum or nickel plating and which is disposed with a required size and a required shape. In addition, the light shielding portion 55 is disposed substantially in parallel to the light emission surface 52 in a position farther from the light emission surface 52 of the irradiation portion 50 than the continuous paper 9. Thus, the light shielding portion 55 is disposed in a state of noncontact with the continuous paper 9.

<Operation of Droplet Ejection Device and Drying Unit>

In the same manner as in the image forming apparatus 1 according to Exemplary Embodiment 1, in the droplet ejection device 1 (FIG. 1) provided with the drying unit 4C, the continuous paper 9 is fed to pass through the droplet ejection portion 30 and the drying portion 40 in this order in the image forming portion 10. The droplet ejection device 1 provided with the drying unit 4C has almost the same operation as the image forming apparatus 1 according to Exemplary Embodiment 1, particularly except for the following different points.

That is, in the drying unit 4C of the drying portion 40, a suction force caused by suction of air acts on the contact guide surface 85*s* of the contact guide portion 85C through the suction holes 86 due to the operation of (the suction unit 83 of) the suction guide unit 80C.

Figure 15:
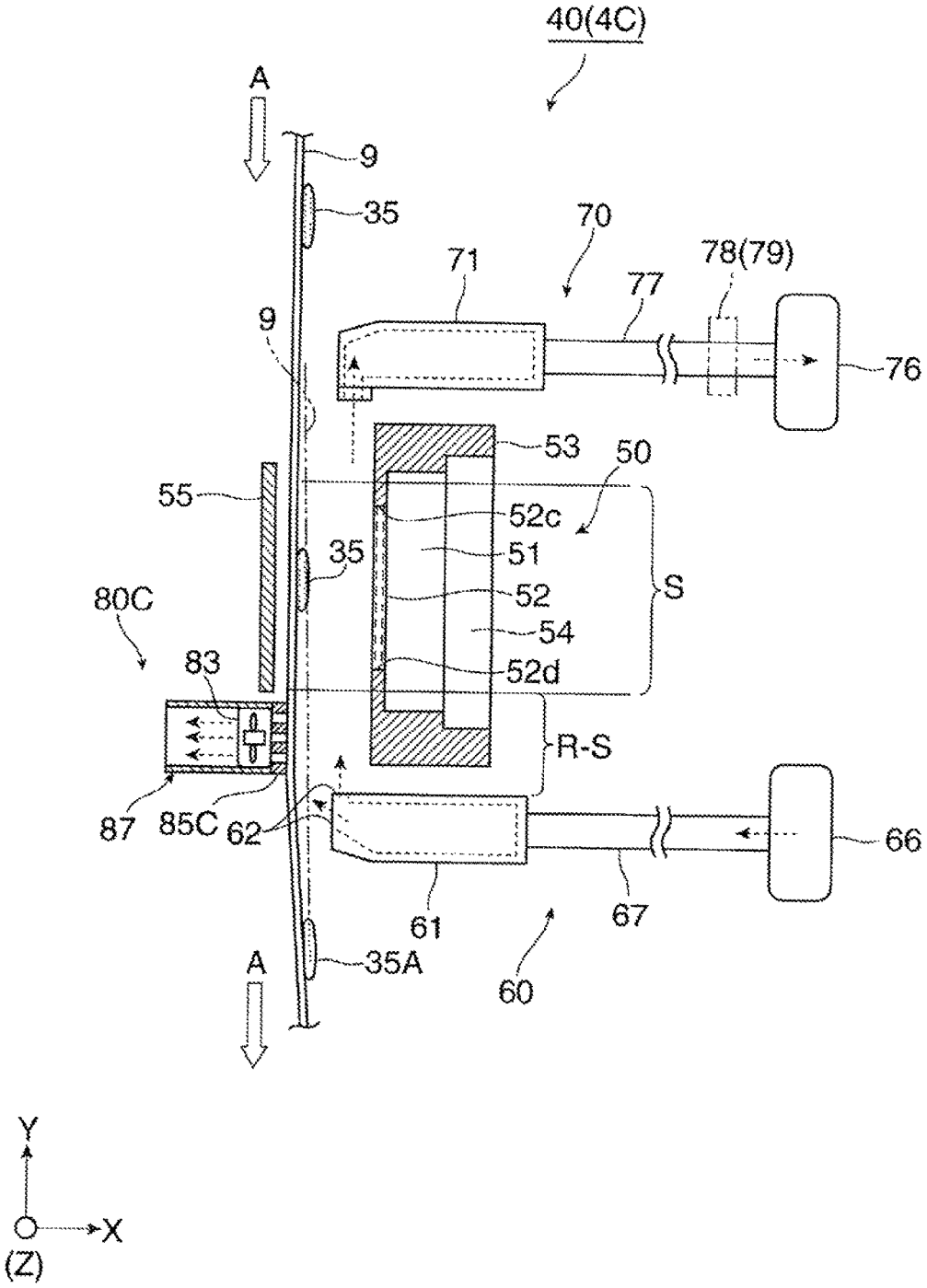
FIG. 15 is a conceptual view illustrating an operating state of the drying unit in FIG. 11.
Figure 16:
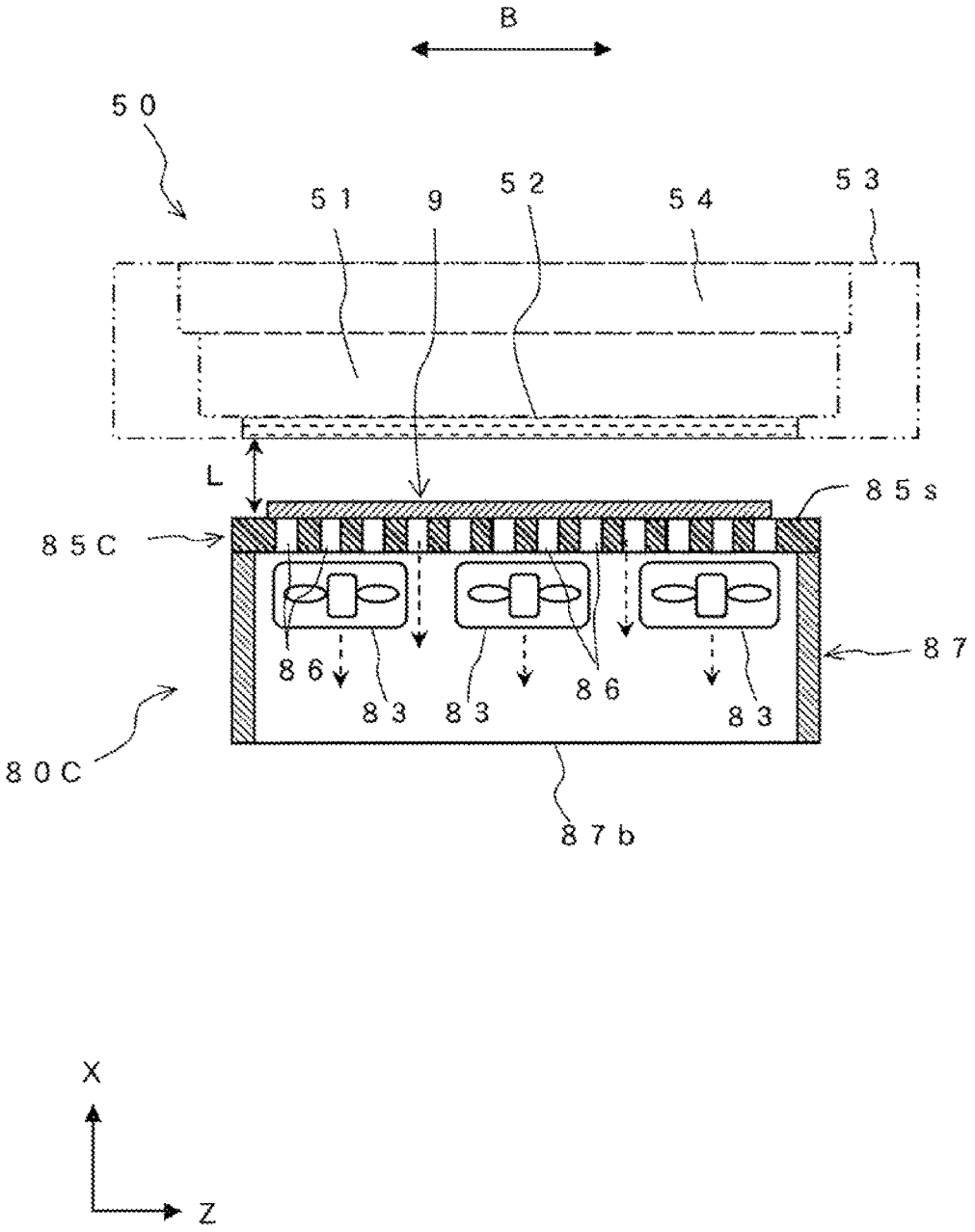
FIG. 16 is a conceptual view illustrating the operating state of the drying unit in FIG. 12, which is shown by the cut end face along the line Q1-Q1.

Consequently the continuous paper 9 which has been in a state of noncontact with the contact guide surface 85*s* of the contact guide portion 85C during the stoppage of the suction guide unit 80C as illustrated in FIG. 11 is sucked on the contact guide surface 85*s* of the contact guide portion 85C due to the suction and fed in contact therewith as illustrated in FIG. 15 or FIG. 16. The continuous paper 9 illustrated by the alternate long and two short dashes line in FIG. 15 is in the state during the stoppage of the suction guide unit 80C.

As a result, the continuous paper 9 is fed in contact with the flat contact guide surface 85*s* in the suction guide unit 80C. Thus, the continuous paper 9 moves keeping a substantially fixed interval from the light emission surface 52 of the irradiation portion 50 located on the upstream side of the contact guide portion 85C in the feeding direction A of the continuous paper 9.

Also in the drying unit 4C, the continuous paper 9 may be shaken and waved on the downstream side of the irradiation portion 50 in the feeding direction A by the air suppled and blown from the outlet 62 of the supply duct 61 in the supply portion 60.

However, in the drying unit 4C, as illustrated in FIG. 15 or FIG. 16, on the upstream side of the outlet 62 of the supply portion 60 in the feeding direction A of the continuous paper 9, the continuous paper 9 is sucked on (the contact guide surface 85*s* of) the contact guide portion 85C of the suction guide unit 80C and fed in contact therewith. Consequently, even if the continuous paper 9 is shaken by the air blown in the supply portion 60, the shaking may be suppressed substantially to disappear due to the contact with the contact guide portion 85C of the suction guide unit 80C.

As a result, when the continuous paper 9 is passing through the irradiation range S of the laser light of the irradiation portion 50, the continuous paper 9 may be subjected to the irradiation with the laser light of substantially constant nature (such as intensity of the irradiation) while moving keeping a substantially fixed interval from the light emission surface 52 of the irradiation portion 50. Thus, in the drying unit 4C, the continuous paper 9 is dried in good condition without drying unevenness.

In addition, in the drying unit 4C, even if a part of the laser light passes through the continuous paper 9 when the laser light is radiated from the irradiation portion 50, the laser light passing through the continuous paper 9 may be absorbed or blocked by the light shielding portion 55. As a result, the laser light passing through the continuous paper 9 may be suppressed from being unintentionally radiated to any other part of the image forming portion 10.

Further, in the drying unit 4C, the suction unit 83 of the suction guide unit 80C is disposed to allow the contact guide portion 85 to be close thereto. Accordingly, the suction guide unit 80C may be miniaturized and the space where the suction guide unit 80C is installed may be reduced, in comparison with the drying unit 4A provided with the suction guide unit 80A or 80B according to Exemplary Embodiment 1 or the modified example thereof.

Second Modified Example of Exemplary Embodiment 2

Figure 17:
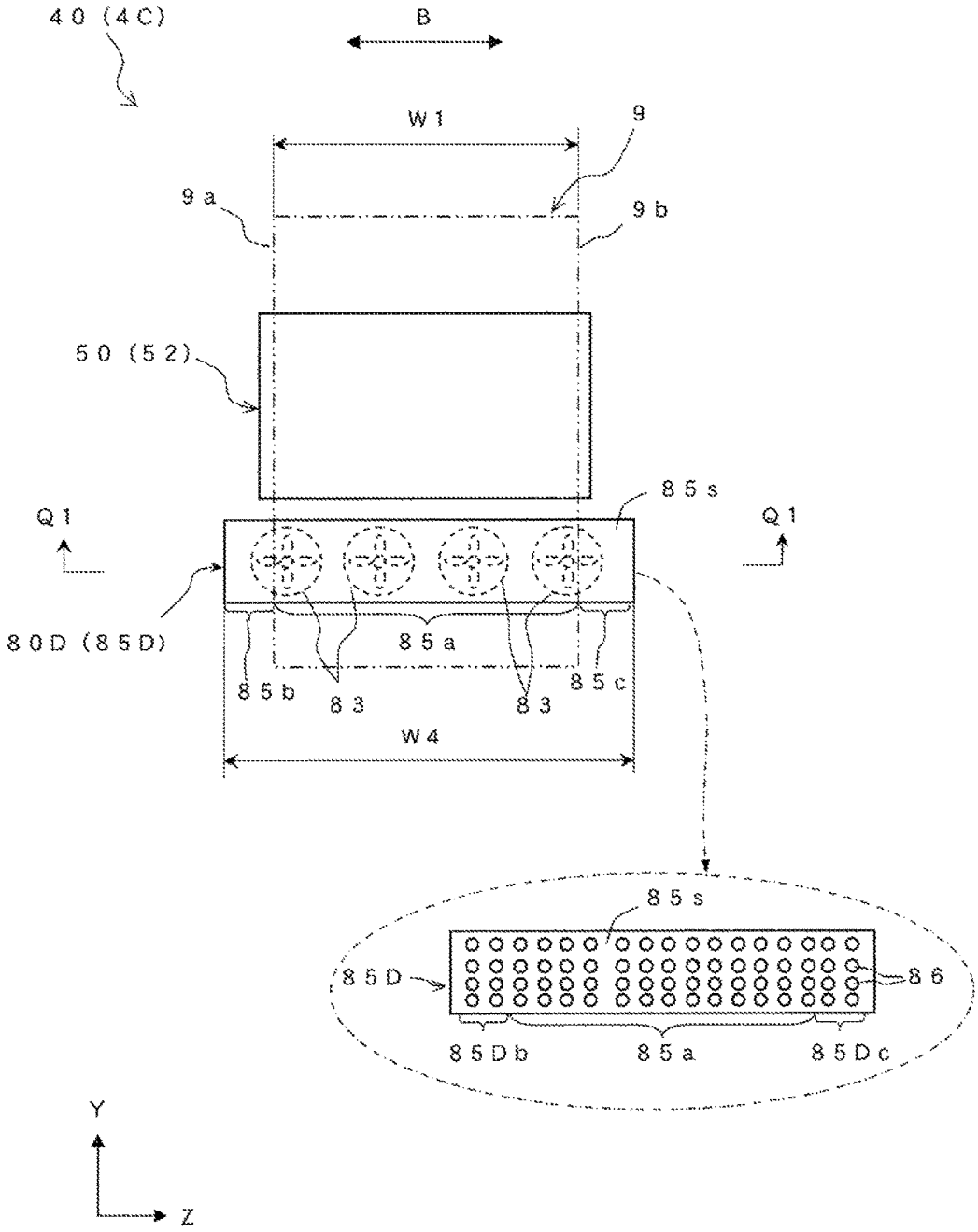
FIG. 17 is a conceptual view illustrating a modified example of the drying unit in FIG. 11, which is observed laterally.
Figure 18:
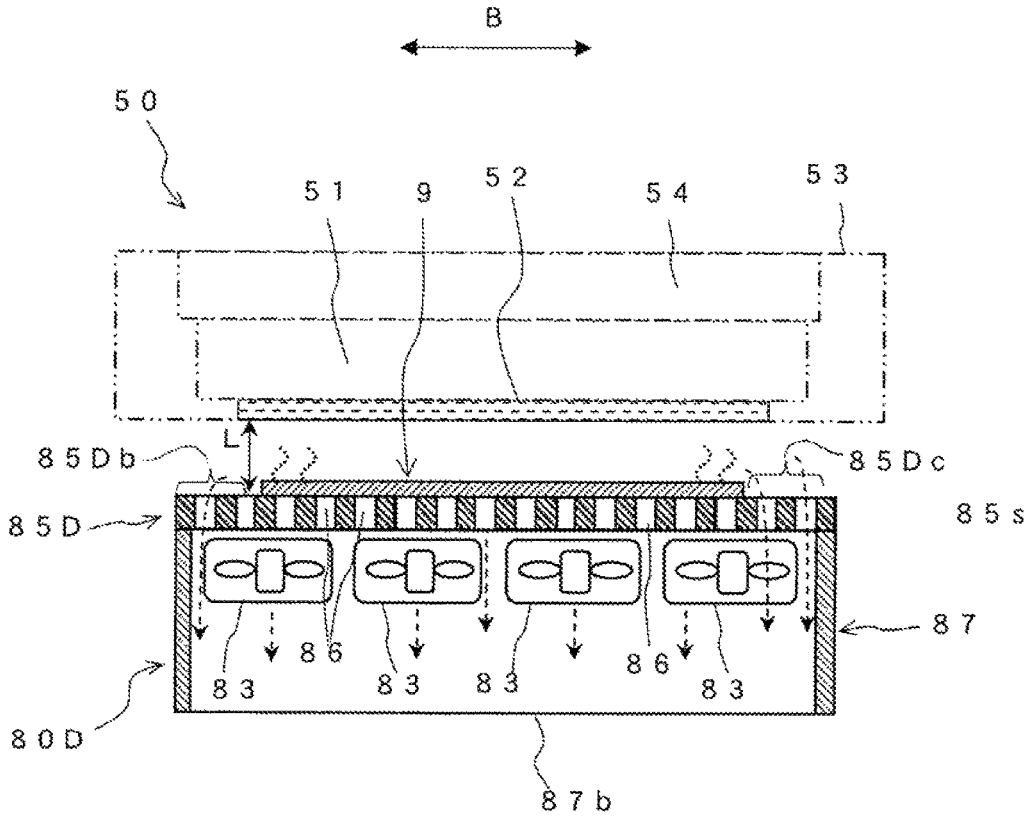
FIG. 18 is a conceptual view illustrating an operating state of the drying unit in FIG. 17, which is shown by a cut end face along a line Q1-Q1.
Figure 18:
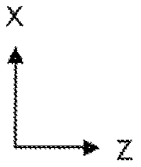

FIG. 17 and FIG. 18 illustrate a modified example of the drying unit 4C according to Exemplary Embodiment 2.

The drying unit 4C in the modified example has the same configuration as the drying unit 4C according to Exemplary Embodiment 2, except that the suction guide unit 80C is replaced by a suction guide unit 80D having a partially different configuration therefrom.

In the suction guide unit 80D in the modified example, a contact guide portion 85D is used as a contact guide portion thereof. In the contact guide portion 85D, some suction holes 86 and suction units 83 are provided in positions outside the opposite end portions 9*a* and 9*b* of the continuous paper 9, as illustrated in FIG. 17 or FIG. 18.

That is, in the contact guide portion 85D, as illustrated in FIG. 17, in addition to the suction holes 86 provided in the region 85*a* corresponding to the width W1 of the continuous paper 9, suction holes 86 are also provided in protruding regions 85Db and 85Dc protruding outside the opposite end portions 9*a* and 9*b* of the continuous paper 9. Accordingly, the contact guide portion 85D has width W4 larger than the width W1 of the continuous paper 9 due to the addition of the protruding regions 85Db and 85Dc.

In addition, the suction guide unit 80D is, for example, designed so that four suction units 83 are arranged in a row along the widthwise direction B of the irradiation portion 50, and the two suction units 83 disposed at the opposite ends of the row are disposed to be partially located outside the opposite end portions 9*a* and 9*b* of the continuous paper 9.

<Operation of Drying Unit>

The droplet ejection device 1 provided with the drying unit 4C according to the modified example operates in the same manner as the droplet ejection device 1 provided with the drying unit 4C (suction guide unit 80C) according to Exemplary Embodiment 2, except that the following effects are additionally provided on the continuous paper 9 passing through the drying unit 4C as will be described below.

In the drying unit 4C according to the modified example, a suction force caused by suction of air acts on the contact guide surface 85*s* of the contact guide portion 85D through the suction holes 86 due to the operation of (the suction unit 83 of) the suction guide unit 80D. Thus, as illustrated in FIG. 18, the continuous paper 9 may be sucked on the inside region 85*a* of the contact guide surface 85*s* excluding the protruding regions 85Db and 85Dc so as to be fed in contact therewith in the same manner as in the case of the operation in Exemplary Embodiment 2.

In addition thereto, in the drying unit 4C, as illustrated in FIG. 18, the protruding regions 85Db and 85Dc where the continuous paper 9 is absent and the suction holes 86 are exposed appear in the contact guide surface 85*s* of the contact guide portion 85D. Thus, of high-humidity air including water vapor (the broken curve in FIG. 18) generated by evaporation of moisture in each ink droplet 35 due to the irradiation with the laser light from the irradiation portion 50, the high-humidity air near the opposite end portions 9*a* and 9*b* of the continuous paper 9 or the high-humidity air that is going to spread outward from the opposite end portions 9*a* and 9*b* may be sucked through the suction holes 86 in the protruding regions 85Db and 85Dc by the suction guide unit 80D.

As a result, in the drying unit 4C, the high-humidity air including water vapor generated by evaporation of moisture in each ink droplet 35 due to the irradiation with the laser light from the irradiation portion 50 may not only be absorbed to ride on the air flow formed by the air supply of the supply portion 60 and the air suction of the absorption portion 70 to be removed through absorption portion 70 but also may be absorbed and removed by the suction guide unit 80D.

Thus, according to the drying unit 4C in the modified example, the water vapor generated by the evaporation of the moisture from each ink droplet 35 is more effectively suppressed or prevented from adhering to the continuous paper 9 again, or the water vapor is more effectively suppressed or prevented from adhering to the light emission surface 52 or the retention member 53 of the irradiation portion 50, there forming into dew drops.

Other Exemplary Embodiments

In each of the drying units 4A and 4C including the modified examples according to Exemplary Embodiments 1 and 2, a configuration example in which the contact guide portion 81 or 85 of the suction guide unit 80 is disposed in a position corresponding to a part (the irradiation range S or the region R-S excluding the irradiation range S) of the region R extending from the irradiation range S of the laser light to the outlet 62 of the supply portion 60 is illustrated as the suction guide unit 80. However, the suction guide unit 80 may have a configuration in which a contact guide portion thereof is disposed in a position corresponding to the whole of the region R or may have a configuration in which a contact guide portion thereof is also disposed in a range beyond the region R.

Although each of Exemplary Embodiments 1 and 2 illustrates an example in which the drying unit 4A or 4C is disposed to dry the continuous paper 9 which is being fed vertically, the invention is not limited thereto. For example, the drying unit 4A or 4C may be disposed to dry the continuous paper 9 which is being fed horizontally or in an inclined direction.

In addition, each of Exemplary Embodiments 1 and 2 illustrates an inkjet recording apparatus as a droplet ejection device 1 provided with the drying unit 4 (A, C) by way of example. However, a droplet ejection device provided with a drying unit represented by the drying unit 4 (A, C) may be another type of droplet ejection device in which liquid droplets must be ejected onto a medium such as the continuous paper 9 and the medium must be irradiated with laser light to evaporate and dry moisture of the liquid droplets.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A drying unit comprising:

an irradiation portion that radiates laser light to a recording medium being fed in a predetermined feeding direction, so as to evaporate moisture of liquid droplets adhering to the recording medium;

a supply portion that blows and supplies air to a space between the irradiation portion and the recording medium through an outlet from a position at a downstream side of the irradiation portion in the feeding direction;

an absorption portion that absorbs at least a part of the air flowing to an upstream side in the feeding direction along the recording medium in a position at an upstream side of the irradiation portion in the feeding direction; and a suction guide unit comprising a contact guide portion that sucks the recording medium in a position opposite to the irradiation portion with respect to the recording medium, the position corresponding to at least a part of a region extending from an irradiation range of the laser light radiated from the irradiation portion to the outlet of the supply portion, so that the recording medium is brought into contact with the contact guide portion and guided to pass through the drying unit.

2. The drying unit according to claim 1, wherein, in the suction guide unit, the contact guide portion is disposed in a position corresponding to the irradiation range of the laser light from the irradiation portion, and is formed from a member having suction holes.

3. The drying unit according to claim 2, wherein the member forming the contact guide portion has a physical property of absorbing the laser light passing through the recording medium.

4. The drying unit according to claim 3, wherein the suction holes in the contact guide portion are provided so that at least one of the suction holes is present in a position outside opposite end portions in a widthwise direction crossing the feeding direction of the recording medium.

5. The drying unit according to claim 2, wherein the suction holes in the contact guide portion are provided so that at least one of the suction holes is present in a position outside opposite end portions in a widthwise direction crossing the feeding direction of the recording medium.

6. The drying unit according to claim 1, wherein the contact guide portion in the suction guide unit is disposed in a position between the irradiation range of the laser light from the irradiation portion and the outlet of the supply portion, and is formed from a member having suction holes.

7. The drying unit according to claim 6, wherein the suction guide unit comprises at least one suction unit disposed at a part of the member forming the contact guide portion opposite to a side where the recording medium is brought into contact with the member.

8. The drying unit according to claim 7, wherein the contact guide portion is provided so that at least a part of the suction holes and the at least one suction unit is located in a position outside opposite end portions in a widthwise direction crossing the feeding direction of the recording medium.

9. A droplet ejection device comprising:

a droplet ejection portion that ejects liquid droplets to a recording medium being fed in a predetermined feeding direction; and a drying portion that is disposed in a position on a downstream side of the droplet ejection portion in the feeding direction, so as to evaporate and dry moisture of the liquid droplets ejected from the droplet ejection portion to adhere to the recording medium; wherein:

the drying portion comprises the drying unit according to claim 1.

10. A drying unit comprising:

irradiation means for radiating laser light to a recording medium being fed in a predetermined feeding direction, so as to evaporate moisture of liquid droplets adhering to the recording medium;

supply means for blowing and supplying air to a space between the irradiation means and the recording medium through an outlet from a position at a downstream side of the irradiation means in the feeding direction;

absorption means for absorbing at least a part of the air flowing to an upstream side in the feeding direction along the recording medium in a position at an upstream side of the irradiation means in the feeding direction; and contact guide means for sucking the recording medium in a position opposite to the irradiation means with respect to the recording medium, the position corresponding to at least a part of a region extending from an irradiation range of the laser light radiated from the irradiation means to the outlet of the supply means, so that the recording medium is brought into contact with the contact guide means and guided to pass through the drying unit.

* * * * *